US005708920A

United States Patent [19]

Ohnishi et al.

[11] Patent Number: 5,708,920

[45] Date of Patent: Jan. 13, 1998

[54] TONER-IMAGE FIXING DEVICE WITH ROLLER-TEMPERATURE LIMITATION

[75] Inventors: Hideki Ohnishi, Chiba; Yukikazu Kamei, Yamatokooriyama; Tomohiro Oikawa, Chiba; Yoshinobu Tateishi, Shiki-gun, all of Japan

[73] Assignee: Sharp Kabushiki Kaisha, Osaka, Japan

[21] Appl. No.: 649,519

[22] Filed: May 17, 1996

[30] Foreign Application Priority Data

May 19, 1995 [JP] Japan ..... 7-121229
Jun. 28, 1995 [JP] Japan ..... 7-161948

[51] Int. Cl.[6] ..... G03G 15/20

[52] U.S. Cl. ..... 399/69; 399/70

[58] Field of Search ..... 355/285; 399/70, 399/69, 67

[56] References Cited

U.S. PATENT DOCUMENTS

| | | | |
|---|---|---|---|
| 3,452,181 | 6/1969 | Stryjewski | 355/285 |
| 4,996,567 | 2/1991 | Watarai et al. | 355/290 |
| 5,019,693 | 5/1991 | Tamary | 219/471 |
| 5,315,350 | 5/1994 | Hirobe et al. | 355/208 |
| 5,412,453 | 5/1995 | Matsuo | 355/208 |
| 5,465,141 | 11/1995 | Asano et al. | 355/285 |

FOREIGN PATENT DOCUMENTS

| | | |
|---|---|---|
| 0 085 950 A1 | 8/1983 | European Pat. Off. . |
| 0 314 099 A3 | 5/1989 | European Pat. Off. . |
| 60-017473 | 1/1985 | Japan . |
| 61-262771 | 11/1986 | Japan . |
| 61-262772 | 11/1986 | Japan . |
| 4-295873 | 10/1992 | Japan . |
| 4-311983 | 11/1992 | Japan . |
| 5-066694 | 3/1993 | Japan . |
| 2 283 458 | 5/1995 | United Kingdom . |

OTHER PUBLICATIONS

Japio Abstract in English of JP 60--017 473, published Jan. 29, 1985.

Japio Abstract in English of JP 61--262 771, published Nov. 20, 1986.

Japio Abstract in English of JP 61--262 772, published Nov. 20, 1986.

Japio Abstract in English of JP 4--295 873, published Oct. 20, 1992.

Japio Abstract in English of JP 4--311 983, published Nov. 4, 1992.

Patent Abstracts of Japan, vol. 9, No. 137 (P--363), abstracting JP 60--17473 of 29 Jan. 1985.

Patent Abstracts of Japan, vol. 17, No. 107 (P--1496), abstracting JP 4--295873 of 20 Oct. 1992.

*Primary Examiner*---Sandra L. Brase
*Assistant Examiner*---Quana Grainger
*Attorney, Agent, or Firm*---David G. Conlin; Milton Oliver

[57] ABSTRACT

A toner image fixing device realizes a stabilized fixing process by smoothly controlling a surface temperature of its heating roller, preventing peeling-off of a layer of the roller core. The toner image fixing device comprises a heating roller consisting of a core covered with a layer of, e.g., a silicon rubber, a heat lamp mounted in the heating roller and a pressure roller for pressing a sheet of paper against the heating roller. The toner image fixing device is provided with a temperature sensor for sensing a surface temperature of the heat roller and for operating the heater lamp at a preset ON-OFF ratio (e.g., 1:3) to elevate the heating roller surface temperature from a first preset value to a second preset value and thereafter to maintain it at the second preset temperature.

9 Claims, 17 Drawing Sheets

TONER-IMAGE FIXING DEVICE WITH ROLLER-TEMPERATURE LIMITATION

BACKGROUND OF THE INVENTION

The present invention relates to a fixing device for fixing by heat an unfixed toner image onto a toner-image-carrying sheet, which is usable in every image forming device using a xerographic process, e.g., a copying machine and a laser printer.

An image forming device using the xerographic process works by forming a latent image on a light-sensitive drum (recording medium), developing the latent image with toner, transferring the toner-developed image onto a sheet paper (toner-image carrier) and fixing the toner-image onto the paper sheet by fusing the toner. Accordingly, the image-forming and fixing process has a fixing device disposed at its downstream of the paper passage, e.g., on this side of an outlet for delivering the paper with a fixed image.

A fixing device has a heating roller with a halogen lamp (heat source) mounted therein and a pressure roller contacting with the heating roller under a specified pressure.

The fixing device is disposed at the side of a delivery portion in a passage after an image forming portion. It receives a sheet of paper carrying a toner-developed image formed thereon from the image-forming portion and fixes the toner-developed image onto the paper by fusing the toner by contacting thereto its hot roller surface.

In the image forming portion, a light-conducting surface of a light-sensitive drum is uniformly charged by an electrostatic charger and light of a desired image is transferred through an optical system to the charged light-conducting surface of the rotating light-sensitive drum to produce thereon a latent image which is then developed with toner (powder) supplied by developing device. A toner-image transferring device disposed at a copying position electrostatically transfers the toner-developed image from the light-sensitive drum onto a paper sheet transported thereto. The paper carrying at one side the unfixed toner image is guided to the fixing device wherein the paper is transported being pressed at its surface with toner-image against the hot surface of the heating roller by the pressure roller. The toner image is fixed by heat onto the paper.

The heating roller of the fixing device is a cylinder-like core made of an aluminum (Al) pipe, which mounts therein the heater lamp and is covered with a layer of, e.g., silicon rubber that can easily release toner. The silicon rubber layer is bonded to the core with adhesive called "primer".

A surface of the heating roller is heated to and kept at a temperature necessary for fixing toner onto the paper. The surface temperature of the heating roller is detected by a temperature sensor (e.g., a thermistor) disposed in contact therewith. The heater lamp in the heating roller is operated according to a temperature detected signal from the temperature sensor to maintain the heating roller surface temperature at the temperature necessary for fixing a toner image.

Japanese Laid-open Patent Publication No. 4-295873 discloses an example of a temperature control of the fixing device. Heater lamp is turned ON when the power supply of, e.g., the copying machine is turned ON and it is continuously operated to rapidly heat up the heating roller to a preset target temperature Ts.

When the surface temperature of the heating roller reached a first preset value To (lower than the preset target temperature Ts), the heater thereafter is operated periodically by turning on and off to prevent an overshoot from occurring due to sharp temperature rise and to minimize a ripple due to differential temperature after reaching the preset target temperature Ts. After the heating roller reaches the preset target temperature Ts, the heater lamp is supplied with electric power while the heating roller surface temperature is lower than the preset target value Ts.

In this case, the heating roller is very poor in thermal response and its core may be excessively heated due to the delay of switching off the heater lamp, resulting in considerably rising of the surface temperature of the heating roller. As a result, a large ripple is formed owing to the surface temperature of the heating roller.

Accordingly, to reduce the large ripple for maintaining the heating roller Ts at the preset temperature Ts, the heater lamp is turned ON for a specified duration (Ton) and turn OFF for a specified duration (Toff) when the heating roller temperature becomes lower than the preset value Ts. By doing so, the surface temperature of the heating roller is maintained at the target preset level Ts to reduce a temperature ripple.

The temperature control method of the fixing device described in Japanese Laid-open Patent Publication No. 4-295873 may be effective to control the heating roller to a toner-fixable temperature Ts. Namely, the above-mentioned control can maintain the preset temperature Ts, reducing a temperature ripple and assuring a stabilized fixing process.

In case of restoring a temperature of the heating roller to the preset value Ts according to the above-mentioned temperature control, the heater lamp is driven for a preset long ON-duration when the temperature of the heating roller dropped lower than the preset value Ts. In particular, the proportion of ON-duration of the heater lamp is very large as compared with the proportion of OFF-duration. Therefore, the heater lamp may excessively work if the temperature Ts is obtained within the ON-duration. In other words, the heater lamp may produce excess heat that heats the heating roller surface over a temperature enough to fuse toner and increases a temperature ripple.

The temperature control method of the fixing device described in Japanese Laid-open Patent Publication No. 4-295873 aims at maintaining a temperature of the heating roller at the preset temperature Ts limiting a ripple. Therefore, this art has no consideration for a temperature of a boundary surface between the aluminum (Al) core and the silicon rubber layer (i.e., a boundary surface temperature of the roller core under the silicon rubber layer). Therefore, in the process of maintaining the heating roller at the preset temperature Ts, the core of the heating roller may be heated over a temperature at which the silicon rubber layer may peel off the core. The long-time operation of the heating roller may also cause such a trouble that the silicone rubber may part from the core.

The silicon rubber is bonded to the aluminum core with adhesive that has a heat resistance of about 180° C. and, therefore, it may peel off the core if the core is overheated to fuse the adhesive bonding the silicon rubber to the core. In case of controlling the surface temperature of the heating roller to about 170° C., the core may be heated over 170° C. If the core is heated over 180° C. for a long time, the adhesive melts and the silicon rubber parts from the core, resulting in the fixing device becoming inoperative.

In this instance, the control of electric power supply to the heater lamp according to the above-mentioned prior art uses a first control temperature To which is lower by 10° C. than the preset target point. The core of the heating roller may exceed 180° C. even at the first control temperature To. Furthermore, the heater lamp is driven at ON-OFF intervals (relatively long ON-duration and relatively short OFF-duration) when the heating roller temperature drops below the preset temperature Ts after having reached said preset temperature Ts. At this time, the core may also be heated excessively and maintained at a temperature allowing the adhesive to be softened and the silicone rubber layer to be unbound from the core with time elapsed.

As described previously, every conventional toner image fixing device is so designed that a part of heat energy generated by every heater lamp may be transferred internally or both internally and externally to the surface of the heating roller realizing quickly attaining a surface temperature enough to fuse and fix toner onto a sheet of recording paper. However, the heating roller having a rubber-covered core may be subjected to peeling-off its rubber from the core as a result of increase of the core boundary temperature during a long time of operation.

Generally, the rubber is bonded to the aluminum core with adhesive called "primer" which has a heat resistance of not higher than 200° C. but in many cases can work only at a temperature up to 180° C. due to deterioration of its quality by the effect of oil contained. To fix a toner image onto the recording paper, it is necessary to maintain the roller surface temperature at a specified temperature and, at the same time, to secure a specified nip (contact surface) width between the paired rollers. These values to be preset depend upon a linear speed of an image-forming device and property of toner to be used. Normally, the roller surface temperature may rise near to 180° C. that corresponds to the practical heat resistance of the primer. Therefore, the roller surface temperature must be preset at a value in a range from 165° C. to 175° C. Any prior-art fixing device that uses only a heating roller or rollers each incorporating a heating element (e.g., halogen lamp) and works with usual temperature control, however, can not maintain the primer portion (boundary between the rubber and the core of the roller) at a temperature lower than 180° C.

SUMMARY OF THE INVENTION

The present invention is directed to solve the above-mentioned problems by providing a fixing device which is capable of controlling electric power supply to a heat source (heater lamp) with a reduced temperature ripple.

The present invention is also intended to prevent excessively heating the heating roller by giving a minimal necessary heat thereto when controlling a temperature of the heating roller after the latter reached the preset level.

Further more, the present invention is directed to provide a toner image fixing device that can quickly arise a surface temperature of a fixing roller to a target value, maintaining a boundary temperature of the roller core in such a range that rubber may not peel off the core.

PREFERRED EMBODIMENT OF THE INVENTION

Figure 1:
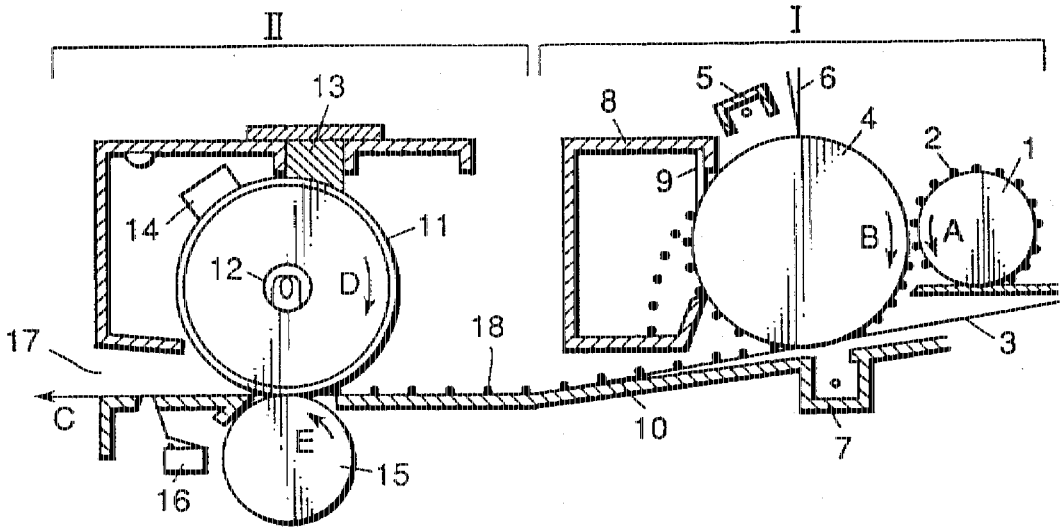
FIG.1 ( PRIOR ART )
FIG. 1 is a sectional view of a conventional image forming device with a fixing device.

FIG. 1 is a view showing an exemplified general construction of a printer that uses a xerographic process of printing. In FIG. 1, there is shown a printer comprising a developing cylinder 1, toner 2, a recording medium (a sheet of paper) 3, a light-sensitive drum 4, static charger 5, an optical system 6, an image-transferring charger 7, a waste-toner box 8, a toner-removing blade 9, a recording-medium guiding plate 10, a fixing roller 11, a heater 12, a cleaner 13, a temperature sensor (e.g., a thermistor) 14, a pressure roller 15 and a recording medium sensor 15. As well known, the optical system 6 builds up a latent image on a light-sensitive drum 4 which in turn picks up toner from the developing cylinder 1 to develop a toner image. The image-transferring charger 7 moves the developed toner image onto the recording medium 3. The recording medium 3 with the developed toner image passes through a nip between the fixing roller 11 and the pressure roller 15 being heated to fix the toner image thereon.

The fixing portion II is disposed at the side of the delivery portion 17 in a passage after an image forming portion I. It receives a sheet of paper 3 carrying a toner-developed image 18 formed thereon from the image-forming portion I and fixes the toner-developed image onto the paper 3 by fusing the toner by contacting thereto its hot roller surface 11 at the fixing portion II.

In the image forming portion I, a light-conducting surface of a light-sensitive drum 4 is uniformly charged by an electrostatic charger 5 and light of a desired image is transferred through an optical system 6 to the charged light-conducting surface of the rotating light-sensitive drum 4 to produce thereon a latent image which is then developed with toner (powder) 2 supplied by developing device 1. A toner-image transferring device 7 disposed at a copying position electrostatically transfers the toner-developed image from the light-sensitive drum 4 onto a paper sheet 3 transported thereto. The paper 3 carrying at one side the unfixed toner image 18 is guided to the fixing portion II wherein the paper 3 is transported being pressed at its surface with toner-image against the hot surface of the heating roller 11 by the pressure roller 15. The toner image is fixed by heat onto the paper 3.

The heating roller 11 of the fixing portion II is a cylinder-like core made. of an aluminum (Al) pipe, which mounts therein the heater lamp 12 and is covered with a layer of, e.g., silicon rubber that can easily release toner. The silicon rubber layer is bonded to the core with adhesive called "primer".

A surface of the heating roller 11 is heated to and kept at a temperature necessary for fixing toner onto the paper 3. The surface temperature of the heating roller 11 is detected by a temperature sensor 14 (e.g., a thermistor) disposed in contact therewith. The heater lamp 12 in the heating roller 11 is operated according to a temperature detected signal from the temperature sensor 14 to maintain the heating roller surface temperature at the temperature necessary for fixing a toner image.

Figure 2:
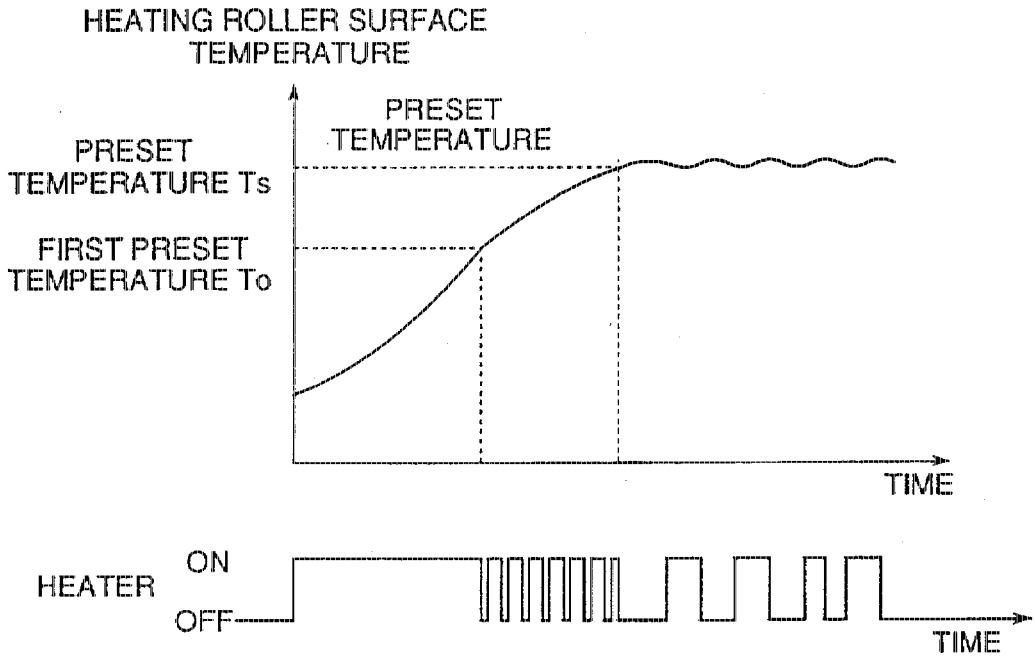
FIG.2 ( PRIOR ART )
FIG. 2 is a time chart showing an example of controlling electric power supply to a heat source in a conventional fixing device.
Figure 3:
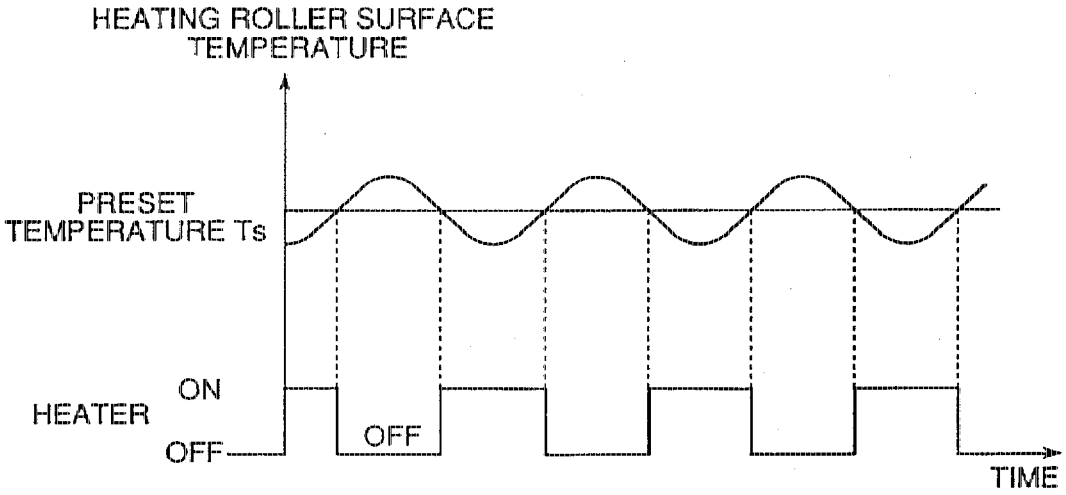
FIG.3 ( PRIOR ART )
FIG. 3 is a time chart showing an example of controlling electric power supply to a heat source for maintaining a suitable fixing temperature in a conventional fixing device.

Japanese Laid-open Patent Publication No. 4-295873 discloses an example of a temperature control of the fixing portion II. As shown in FIGS. 2 and 3, heater lamp 12 (FIG. 1) is turned ON when the power supply of, e.g., the copying machine is turned ON and it is continuously operated to rapidly heat up the heating roller 11 to a preset target temperature Ts.

When the surface temperature of the heating roller reached a first preset value To (lower than the preset target temperature Ts), the heater 12 thereafter is operated periodically by turning on and off to prevent an overshoot from occurring due to sharp temperature rise and to minimize a ripple due to differential temperature after reaching the preset target temperature Ts. After the heating roller reaches the preset target temperature Ts, the heater lamp 12 is supplied with electric power while the heating roller surface temperature is lower than the preset target value Ts as shown in FIG. 3.

In this case, the heating roller 11 is very poor in thermal response and its core may be excessively heated due to the delay of switching off the heater lamp 12, resulting in considerably rising of the surface temperature of the heating roller 11. As a result, a large ripple is formed owing to the surface temperature of the heating roller.

Figure 4:
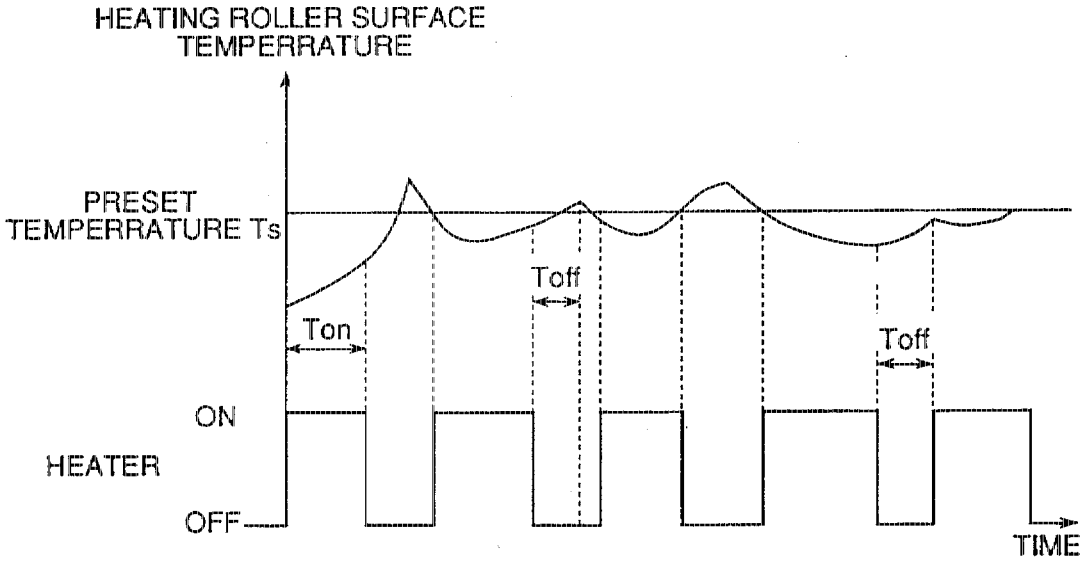
FIG.4 ( PRIOR ART )
FIG. 4 is a time chart showing an example of controlling electric power supply to a heat source for maintaining a suitable fixing temperature in a conventional fixing device.

Accordingly, to reduce the large ripple for maintaining the heating roller Ts at the preset temperature Ts, the heater lamp 12 is turned ON for a specified duration (Ton) and turn OFF for a specified duration (Toff) when the heating roller temperature becomes lower than the preset value Ts as shown in FIG. 4. By doing so, the surface temperature of the heating roller 11 is maintained at the target preset level Ts to reduce a temperature ripple.

The temperature control method of the fixing device described in Japanese Laid-open Patent Publication No. 4-295873 may be effective to control the heating roller 11 to a toner-fixable temperature Ts. Namely, the above-mentioned control can maintain the preset temperature Ts, reducing a temperature ripple and assuring a stabilized fixing process.

In case of restoring a temperature of the heating roller 11 to the preset value Ts according to the above-mentioned temperature control, the heater lamp 12 is driven for a preset long ON-duration when the temperature of the heating roller dropped lower than the preset value Ts. In particular, the proportion of ON-duration of the heater lamp 12 is very large as compared with the proportion of OFF-duration. Therefore, the heater lamp 12 may excessively work if the temperature Ts is obtained within the ON-duration. This is similar to the case of FIG. 2. In other words, the heater lamp may produce excess heat that heats the heating roller surface over a temperature enough to fuse toner and increases a temperature ripple.

The temperature control method of the fixing device described in Japanese Laid-open Patent Publication No. 4-295873 aims at maintaining a temperature of the heating roller 11 at the preset temperature Ts limiting a ripple. Therefore, this art has no consideration for a temperature of a boundary surface between the aluminum (Al) core and the silicon rubber layer (i.e., a boundary surface temperature of the roller core under the silicon rubber layer). Therefore, in the process of maintaining the heating roller 11 at the preset temperature Ts, the core of the heating roller 11 may be heated over a temperature at which the silicon rubber layer may peel off the core. The long-time operation of the heating roller 11 may also cause such a trouble that the silicone rubber may part from the core.

The silicon rubber is bonded to the aluminum core with adhesive that has a heat resistance of about 180° C. and, therefore, it may peel off the core if the core is overheated to fuse the adhesive bonding the silicon rubber to the core. In case of controlling the surface temperature of the heating roller 11 to about 170° C., the core may be heated over 170° C. If the core is heated over 180° C. for a long time, the adhesive is melt and the silicon rubber parts from the core, resulting in that the fixing device becomes out of use.

In this instance, the control of electric power supply to the heater lamp 12 according to the above-mentioned prior art uses a first control temperature To being lower than by 10° C. from the preset target point. The core of the heating roller 11 may exceed 180° C. even at the first control temperature To. Furthermore, the heater lamp 12 is driven at ON-OFF intervals (relatively long ON-duration and relatively short OFF-duration) when the heating roller temperature drops below the preset temperature Ts after having reached said preset temperature Ts. At this time, the core may also be heated excessively and maintained at a temperature allowing the adhesive to be softened and the silicone rubber layer to be unbound from the core with time elapsed.

The present invention is directed to solve the above-mentioned problems by providing a fixing device which is capable of controlling electric power supply to a heat source (heater lamp) with a reduced temperature ripple.

The present invention is also intended to prevent excessively heating the heating roller by giving a minimal necessary heat thereto when controlling a temperature of the heating roller after the latter reached the preset level.

Figure 5:
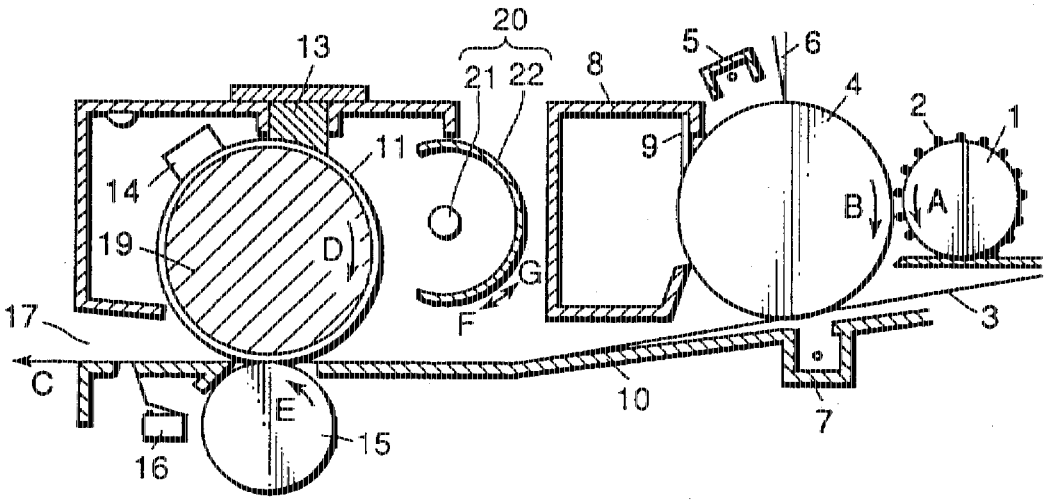
FIG.5 ( PRIOR ART )
FIG. 5 is a construction view for explaining another example of a conventional printer being in the state "for preparation to work".
Figure 6:
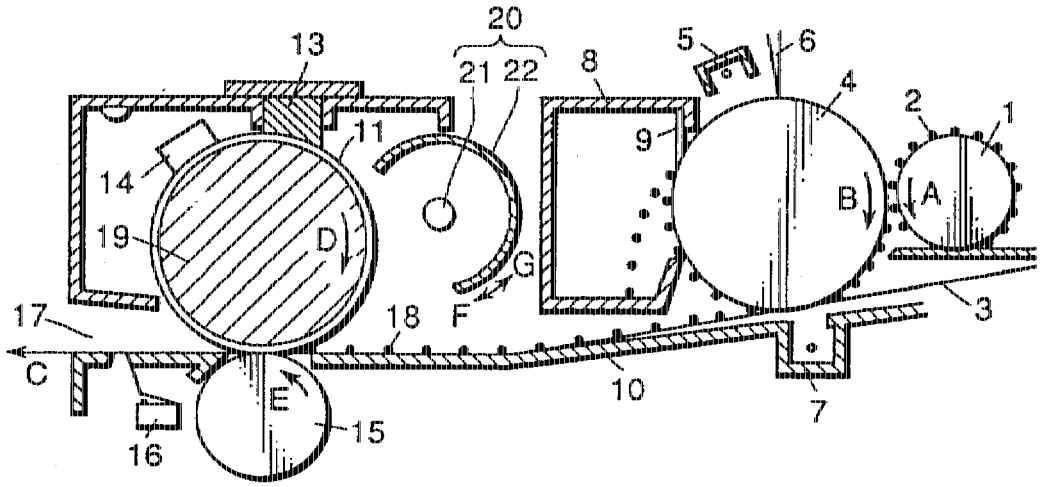
FIG.6 ( PRIOR ART )
FIG. 6 is a construction view for explaining the conventional printer of FIG. 5 being in the working state.

FIGS. 5 and 6 are schematic construction views of another conventional printer that also uses the similar xerographic process of printing. FIG. 5 shows the printer in the state for preparation prior to printing (copying) and FIG. 6 shows the printer in the working state. Portions similar to those of the printer shown in FIG. 1 are given the same reference numerals. In FIGS. 5 and 6, numeral 19 designates a heat accumulator and numeral 20 designates an external heating means (heater) which comprises a heater 21, a reflector 22 for reflecting heat from the heater to toner 18 on the recording medium 3 or to the fixing roller 11. The printer of FIGS. 5 and 6 is similar to the printer of FIG. 1 except that the fixing roller 11 does not contain a heater therein and contains the heat accumulator 19 therein to be heated with heat from the external heating means 20 and the latter is also used for heating the toner 18 on the recording medium 3.

As shown in FIG. 5, in the stage of preparation for printing, the fixing roller 11 and pressure roller 15 rotate in respectively marked directions D and E, being heated by heat from the heater 21 (or external heating means 20). At this time, the reflector 22 of the heater 21 is directed to the fixing roller 11. When the surface temperature of the roller 11 reached a preset temperature, the recording medium 3 (FIG. 6) is fed and comes into contact with the light-sensitive drum 4 wherefrom the toner 2 is transferred onto the recording medium 3. The recording medium 3 then advances in the direction C. The reflector 22 rotates in the direction G to oppose the surface of the fixing roller 11 and the surface of the recording medium 3. The toner 18 on the recording medium at the inlet of the fixing roller is fused thereon by heat from the heater 21. The toner 18 is completely fixed on the recording medium 3 by the effect of heat from the fixing roller 11 and the pressing force from the pressure roller 15. The recording medium is then discharged out of the printer, at which a printing cycle is finished. When the recording medium 3 passed the fixing device, the detector 16 actuates and generates a detection signal that effects the reflector 22 to turn in the direction F to heat the fixing roller 11 in the preparation state.

Figure 7:
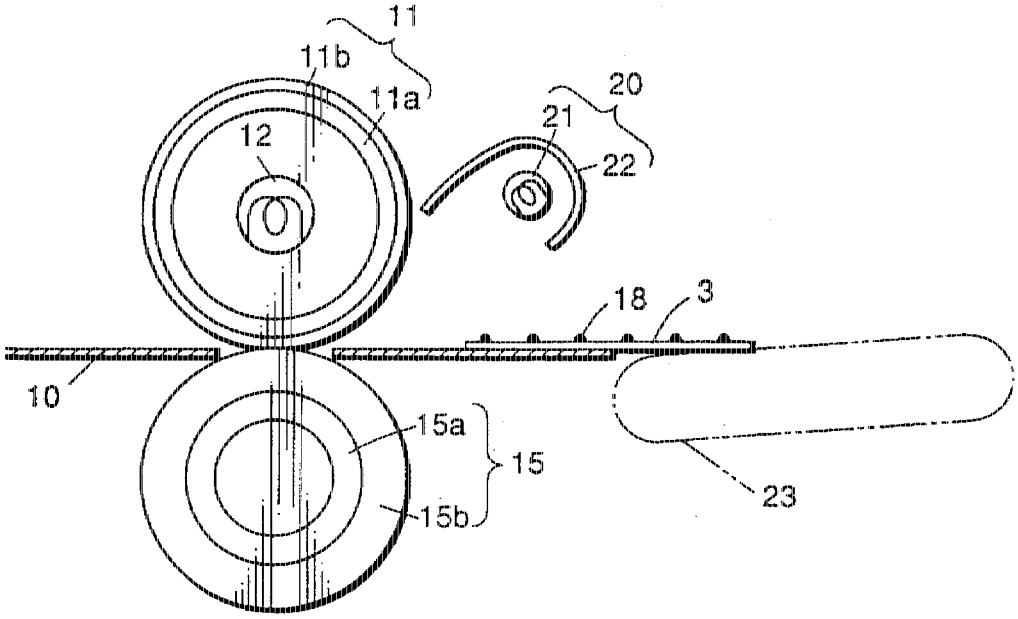
FIG.7 ( PRIOR ART )
FIG. 7 is a view for explaining an example of a printer to which the present invention is applied.
Figure 8:
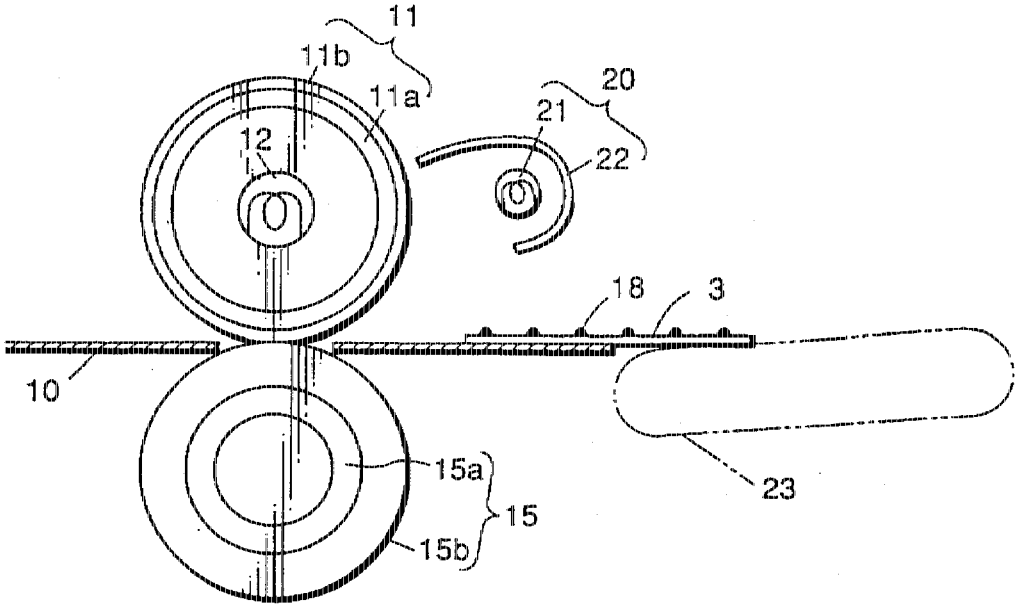
FIG.8 ( PRIOR ART )
FIG. 8 is a view for explaining an example of a printer to which the present invention is applied and which corresponds to the printer of FIG. 7 when a fixing roller is being heated by an external heating means.

FIGS. 7 and 8 are schematic sectional view of another example of a prior art fixing device that comprises a heating roller 11 and a pressure roller 15. The heating roller 11 consists of a metal-made hollow core 11*a* and a heat-resistant releasable layer 11*b* and contains therein a heater 12. The pressure roller 15 consists of a metal-made hollow core 15*a* and a heat-resistant releasable layer 15*b*. Numeral 20 designates external heating means composed of a heat-radiation heater 21 (e.g., halogen lamp or infrared lamp emitting heat radiation) and a reflector 22 that serves conversing means for concentrating radiation near at a nip (contacting portion) between the heating roller 11 and the pressure roller 15.

The operation of the thus constructed fixing device will be described as follows:

A recording medium 3 carrying an unfixed toner image 18 fed by a transporting belt 23 is first subjected to heat radiation from the reflector 22 of the external heating means 20 as shown in FIG. 7. The recording medium 3 is further fed and passes a nip between the heating roller 11 and the pressure roller 15, being heated as sandwiched therebetween by the heating roller 11 (heater 12 contained therein) and the external heating means 21 as shown in FIG. 8. This fixing device works to fix by fusing toner 18 onto the recording medium 3 by two-step heating by the heater 21 of the external heating means and the heater 12 in the heating roller 11. As thermoplastic resin component contained in toner 18 is softened and melted, the toner 18 is fixed onto the carrying medium 3 by the effect of bonding power produced between its particles and between the particle and the carrying medium 3. In other words, two heaters supplies respective portions of heat necessary for fixing the toner 18 onto the carrying medium 3, making it possible to save heat energy from the heating roller 11 being in contact with the pressure roller by heat energy supplied from the external heating means 20 in the first stage of heating.

Figure 9:
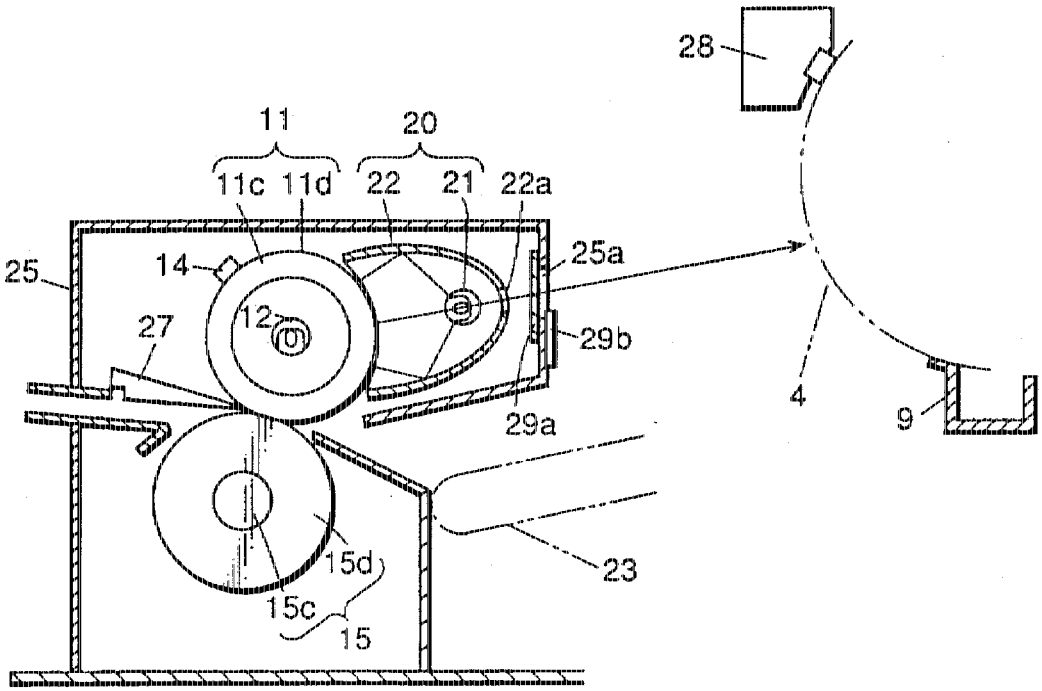
FIG.9 ( PRIOR ART )
FIG. 9 is a view for explaining another example of a printer to which the present invention is applied.

FIG. 9 is a schematic sectional view of another example of a prior-art fixing device that comprises a pair of fixing rollers (an upper roller 11 and a lower roller 15) pressed against each other by springs (not shown) and disposed in a casing 25. The upper fixing roller 11 contains a fixing heater 12 consisting of a heating lamp having a length substantially equal to the roller length. An auxiliary heater 21 consisting of a heating lamp (halogen lamp) is also disposed opposite to the upper fixing roller 11. This upper fixing roller 11 is an aluminum pipe 11*c* having a wall thickness of not more than 10 mm with a fluoride resin coat of not more than 40 microns in thickness. The lower roller 15 has a revolving axis 15*c* with a cylindrical body 15*d* of silicone rubber. Thermal conductivity of the aluminum pipe 11*c* is 0.2 to 0.5 cal/cm.sec.°C. and thermal conductivity of the fluoride resin coat 11*d* is $3\times10^{-4}$ to $6\times10^{-4}$ cal/cm.sec.°C. In FIG. 9, numeral 14 designates a temperature sensor for sensing a surface temperature T of the upper fixing roller 11 and numeral 27 is a finger for separating a copy sheet. A reflector 22 is a mirror having substantially convex cross section, which collects heat light and directs it to cylindrical surface of the upper fixing roller 11.

The reflector 22 has a slit-like opening 22*a* in its bottom and the casing 25 has a slit-like opening 25*a* in its portion opposing the bottom of the reflector 22. Light from the auxiliary heater 21 through the openings 22*a* and 25*a* reaches a surface of light-sensitive drum 4 exposed between a toner separator 9 and cleaning device 28. Namely, light from the heating lamp 21 of the auxiliary heater 20 is used for discharging the light-sensitive drum prior to the proceeding printing cycle. In FIG. 9, a filter 29*a* covers the opening 25*a* of the casing 25 to suppress light of frequencies causing light fatigue of the light-sensitive drum 4 and to decrease the light intensity to that suitable for discharging the light-sensitive drum 4. A shutter plate 29*b* is slidable in a vertical direction to adjust an area of the opening 25*a* of the casing 25.

Figure 10:
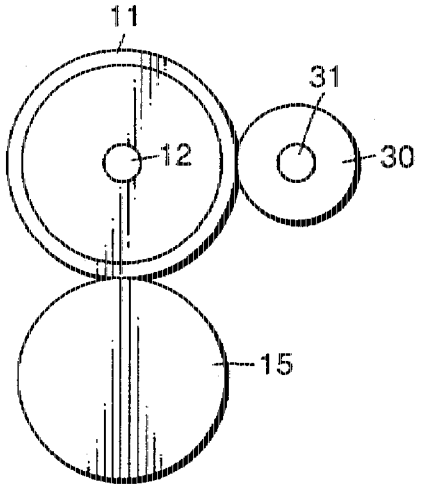
FIG.10 ( PRIOR ART )
FIG. 10 is a construction view showing an example of a fixing portion of a printer to which the present invention is applied.

FIG. 10 is a schematic construction view of another example of a prior-art fixing device. This fixing device is composed of a main heating roller 11, a pressure roller 15 and an auxiliary heating roller 30. The main heating roller 11 incorporates, in its center portion, a heater lamp 12 as a heat source. The auxiliary heating roller 30 at its cylindrical surface is in contact with the main heating roller 11 and smaller in diameter than the main heating roller 11. The auxiliary heating roller 30 incorporates an auxiliary heating lamp 31. As the auxiliary roller 30 may elevate its surface temperature faster than the main heating roller 11, the latter may be heated internally and externally to quickly attain a specified temperature.

As described previously, every conventional toner image fixing device is so designed that a part of heat energy generated by every heater lamp may be transferred internally or both internally and externally to the surface of the heating roller realizing quickly attaining a surface temperature enough to fuse and fix toner onto a sheet of recording paper. However, the heating roller having a rubber-covered core may be subjected to peeling-off its rubber from the core as a result of increase of the core boundary temperature during a long time of operation.

Generally, the rubber is bonded to the aluminum core with adhesive called "primer" which has a heat resistance of not higher than 200° C. but in many cases can work only at a temperature up to 180° C. due to deterioration of its quality by the affection of oil contained. To fix a toner image onto the recording paper, it is necessary to maintain the roller surface temperature at a specified temperature and, at the same time, to secure a specified nip (contact surface) width between the paired rollers. These values to be preset depend upon a linear speed of an image-forming device and property of toner to be used. Normally, the roller surface temperature may rise near to 180° C. that corresponds to the practical heat resistance of the primer. Therefore, the roller surface temperature must be preset at a value in a range from 165° C. to 175° C. Any prior-art fixing device that uses only a heating roller or rollers each incorporating a heating element (e.g., halogen lamp) and works with usual temperature control, however, can not maintain the primer portion (boundary between the rubber and the core of the roller) at a temperature lower than 180° C.

Accordingly, the present invention was made to provide a toner image fixing device that can quickly arise a surface temperature of a fixing roller to a target value, maintaining a boundary temperature of the roller core in such a range that rubber may not peel off the core.

Figure 11:
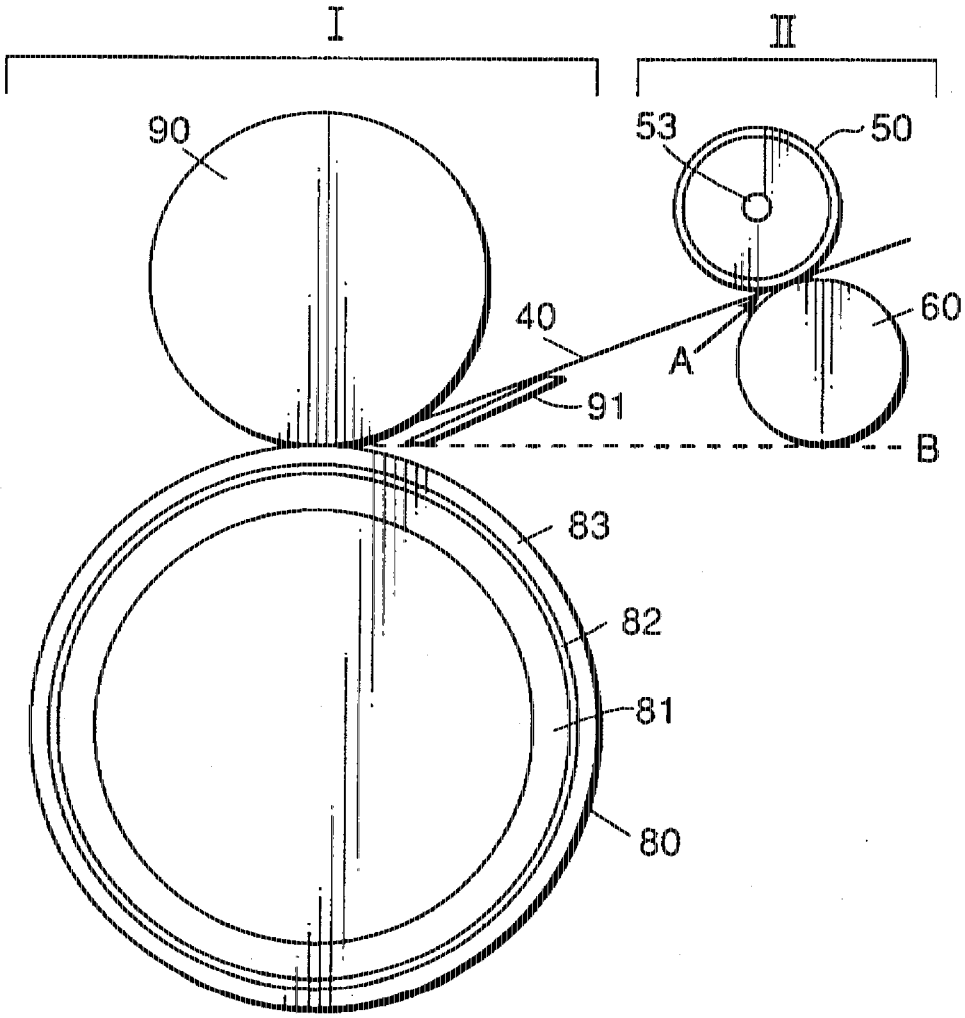
FIG. 11 is a sectional view of an essential portion of a color image forming device with a fixing device according to the present invention.

FIG. 11 is an enlarged view for explaining an example of a color image forming device applied a toner image fixing device according to the present invention.

In FIG. 11, item I designates an image forming portion that comprises a light-sensitive drum 90, processing means (not shown) necessary for forming a desired toner image on the light-sensitive drum 90 and a toner-image transferring drum 80 for transferring toner image from the light-sensitive drum 90 onto the a sheet of paper.

As shown in FIG. 11, the light-sensitive drum 90 is provided with peripherally arranged devices such as a static charger for uniformly charging the light-sensitive drum surface, an optical system for transferring a light-image onto the electrically charged surface of the light-sensitive drum 90, a plurality of color developers for developing respective latent images with respective color toner (powder), a transferring portion for transferring developed color images onto a paper sheet 40 by closely contacting the latter to the toner-image transferring drum 80, a cleaning device for removing remaining toner from the light-sensitive drum surface, a discharger for removing a remaining static charge and so on.

The toner-image transferring drum 80 has a circumferential length sufficient to wind a paper sheet of a maximum size and made of a cylinder 81 internally covered with a layer 82 and externally covered with a layer 83. The drum 80 attracts the paper sheet 40 onto its external surface layer 83 by the effect of, e.g., static charge in synchronism with rotation of the light-sensitive drum 90 in such a way that a front edge of the paper sheet may meet with that of a page of a toner image formed on the light-sensitive drum 90.

A fixing portion II according to the present invention is disposed on the side of a light-sensitive drum 90 relative to a straight line passing the center of the light-sensitive drum 90 and the center of the toner-image transferring drum 80, i.e., a tangential line direction B from a nip formed between the toner-image transferring drum 80 and the light-sensitive drum 90. The fixing device is so arranged that the nip (contacting portion) A between its heating roller 50 and pressure roller 60 is located above the tangential line B.

The paper sheet 40 after receiving the toner image thereon is separated by a separator 91 from the toner-image transferring drum 80 and guided to the fixing portion II. The separator 91 works synchronously with rotation of the toner-image transferring drum 80. It is apart from the drum surface till the completion of transferring the toner image onto the paper sheet 40 and then contacts thereto to separate the front edge of the paper from the drum surface.

The paper sheet 40 separated from the toner-image transferring drum 80 reaches the heating roller 50 of the fixing device and enters into the nip portion A between the heating roller 50 and the pressure roller 60. In this time, the paper sheet 40 is linearly guided without changing its state to the nip portion of the fixing device.

Because the paper sheet 40 can be linearly guided to the heating roller 50 without being forcibly bent, toner image can be satisfactorily fixed on the paper sheet without stripping or scattering of unfixed toner. High-quality fixing of the toner image is also assured since the paper sheet 40 is previously heated by the heating roller and then enters into the nip portion A.

Figure 12:
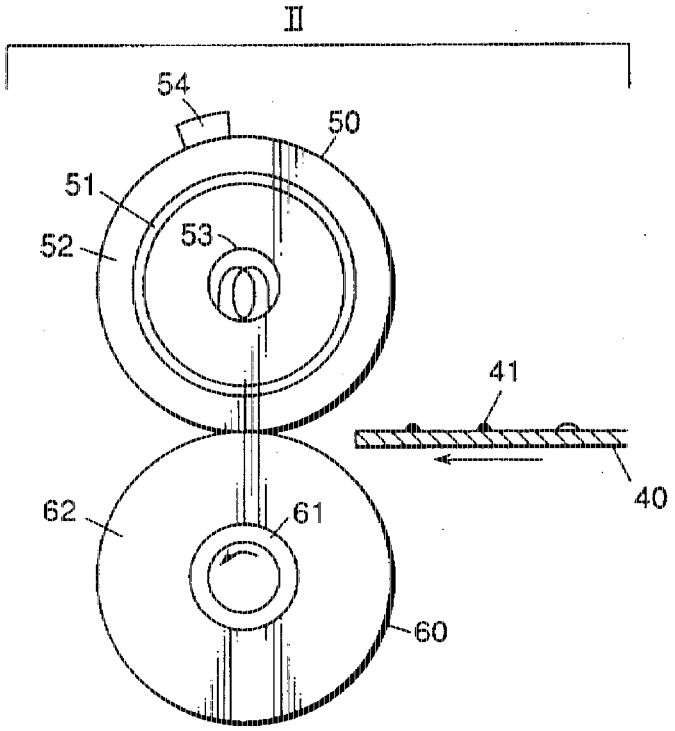
FIG. 12 is a sectional view of an example of a toner-image fixing device embodying the present invention.

FIG. 12 shows the detail of fixing portion II. The fixing portion II according to the present invention is composed of the heat roller 50 and the pressure roller 60. The heating roller 50 has an aluminum (Al) core 51 externally covered with a layer 52 of, e.g., silicon rubber that can easily release toner. The silicon rubber layer 52 is bonded to the core 51 with adhesive called "primer". The heating roller 50 mounts therein the heater lamp 53 (e.g., a halogen lamp) that works as a heat source for heating the heating roller and keeping its surface temperature at a necessary fixing temperature (preset temperature).

The heating roller 50 is paired with the pressure roller 60 that forms a suitably wide nip (contact) with the heating roller 50 for effectively fixing the toner onto the paper sheet 40 and forces the paper sheet 40 to closely contact with the cylindrical surface of the heating roller 50. For this purpose, the pressure roller 60 consists of a rotatably supported core 61 covered with thick and/or low-hard silicon rubber or PFA (Perfluoroalkyl=Etylene Copolymer Resin) coated sponge layer 62 that has an increased heat-insulating property for minimizing a surface temperature drop of the heating roller and can form a wide (in the paper passing direction) nip with the heating roller 50.

Electric power supply of the heater lamp 53 is ON-OFF controlled to keep the surface temperature of the heating roller 50 at a preset temperature. For this purpose, a temperature sensor 54 consisting of a thermistor disposed in contact with the heating roller surface. The power supply of the heater lamp 53 is controlled by a control system shown in FIG. 13 according to the output of the temperature sensor 54.

Figure 13:
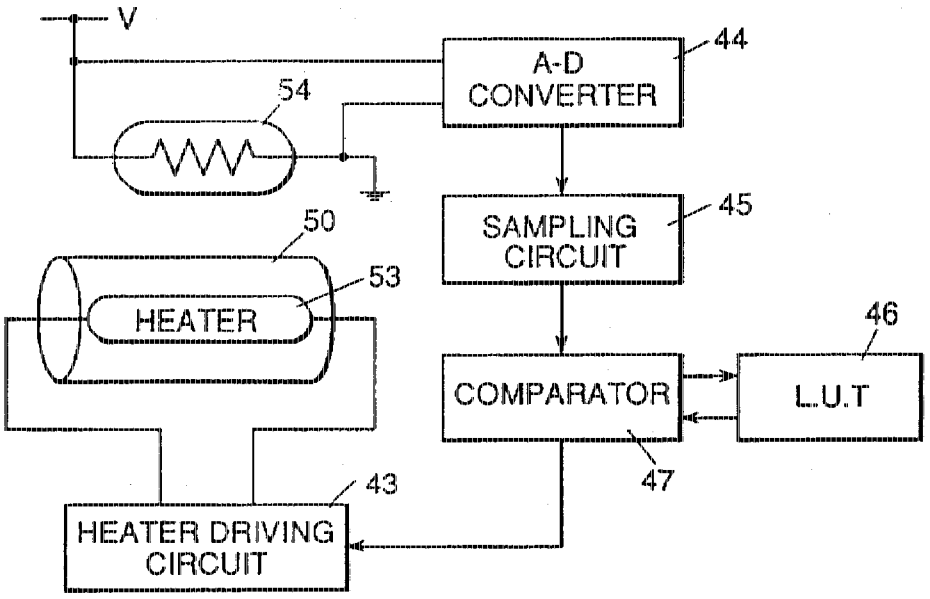
FIG. 13 is a block diagram of a control system for electric power supply of a fixing device according to the present invention.

FIG. 13 shows an example of a control circuit supplying a electric power with the heater lamp 53. The heater lamp 53 is energized through a heater driving circuit 43. A detection signal of a temperature sensor 54 is digitized by an A-D converter 44 and quantized by a sampling circuit 45. A comparator circuit 47 compares thus converted value to a value corresponding to a preset temperature, which is stored in a look-up table 46, and outputs a comparison result. The electric power supply of the heater lamp 53 is then controlled through the heater driving circuit 43 according to the comparison result.

The look-up table 46 stores values corresponding to respective preset temperatures and values corresponding to electric power values to be supplied through the heater driving circuit 43 to the heater lamp 53 according to comparison results. The power supply control may be effected by controlling a duration at a constant voltage or by controlling a current value of a constant period or a voltage value of a constant period or by using a combination of the methods. One of the methods is also stored in the table 46.

According to the present invention, the electric power supply is controlled by controlling a duration at a constant voltage. For example, the heater lamp 53 is provided with a memory of ON-OFF ratio (a ratio of power supply (ON) duration to no-power supply (OFF) duration). A current value to be supplied for a specified duration and a voltage value to be supplied for a specified duration are stored. The ON-OFF ratio control according to the present invention is to control consumable electric power just like the voltage or current control. The following description relates to the ON-OFF ratio control that not only controls ON-duration but also controls a voltage value or a current value. For convenience of explanation, the ON-OFF ratio control will be described in an instance of controlling an ON-duration and an OFF-duration for power supply at a constant voltage.

Figure 14:
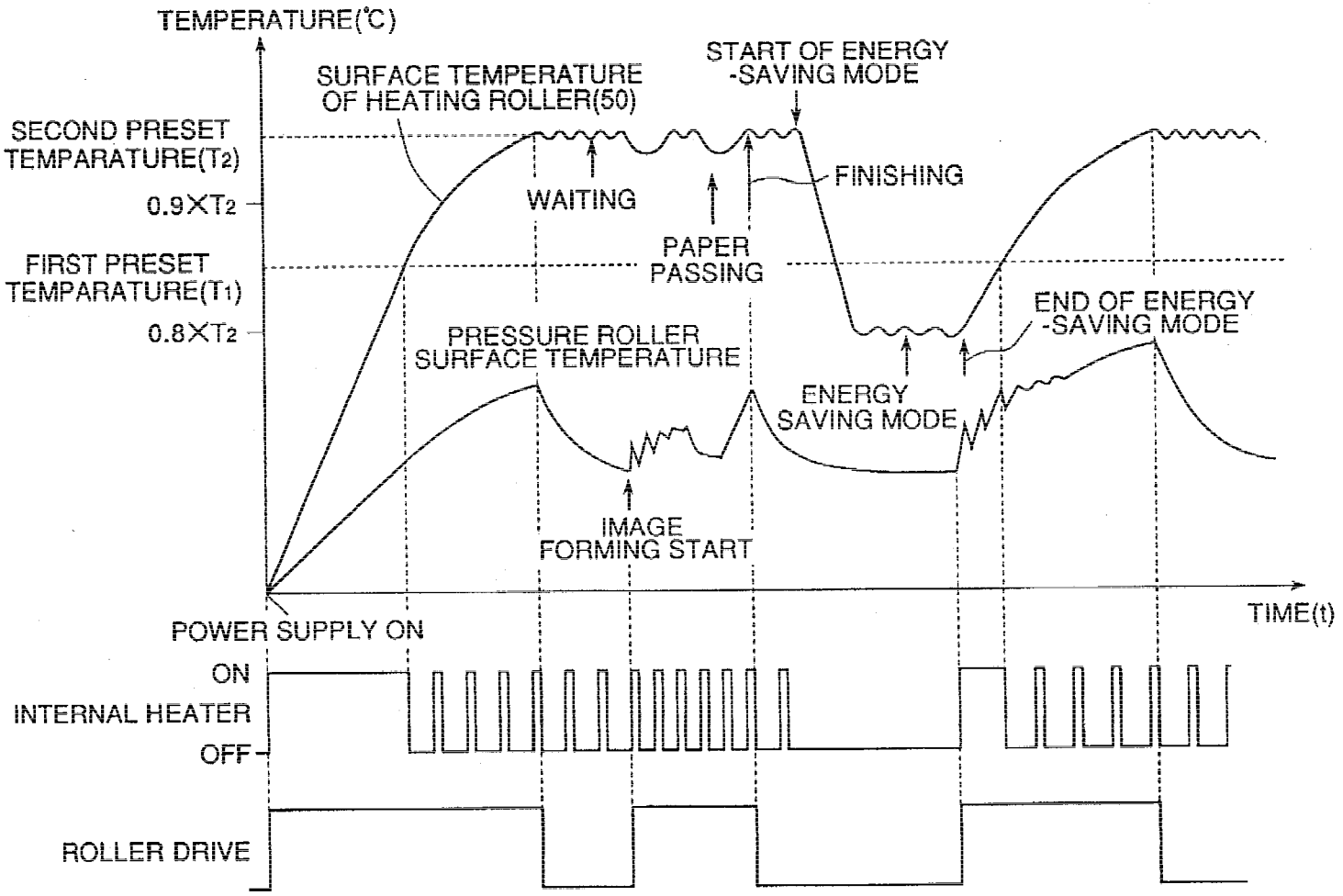
FIG. 14 is a time chart of temperature control of a toner image fixing device according to the present invention.

Referring to the time chart of FIG. 14, an example of temperature control of the fixing portion II according to the present invention will be described below:

In FIG. 14, a first preset temperature $T_1$ is a surface temperature of the heating roller 50, which is lower than a second preset temperature $T_2$ being suitable for fixing toner image and at which the boundary surface temperature of the heating roller core reaches an upper limit temperature not allowing the rubber layer 52 to peel off the core. For example, the upper limit temperature of the heating roller is assumed to be 180° C. The heater lamp 53 is supplied with power current until the boundary surface temperature of the core 51 reaches the upper limit temperature. A surface temperature of the heating roller 50 measured at this moment is set as the first preset temperature $T_1$. Namely, a surface temperature of the heating roller 50, whereat the core takes the upper limit temperature, is set as the first preset temperature $T_1$. Namely, the first preset temperature $T_1$ is a surface temperature of the heating roller 50 at which the core takes 180° C. not causing the rubber layer 52 to peel off the core surface.

More practically, the heating roller 50 is a 2 mm thick wall and 30 mm diameter cylinder-like aluminum core 51 covered with a laminated coat 52 consisting of a 900 to 940 micron thick high-heat-conducting LTV rubber layer, a 30 to 50 micron thick fluoroelastomer (repelling) layer and 30 to 50 micron thick toner-releasable LTV (surface) layer. The pressure roller 60 is a 2 mm thick wall and 30 mm diameter cylinder-like core covered with a 5.5 mm thick LTV rubber 62 having a PFA tube layer thereon. By using an 800-watt halogen lamp as the heater lamp 53, the heating roller was heated: the surface temperature of the heating roller was 134° C. when the temperature of the core 51 was within 170° C. to 180° C., in particular 175° C. (preset as an upper limit temperature). Consequently, 134° C. is adopted as the first preset temperature $T_1$.

As described above, a diameter of the heating roller 50, wall thickness of the core 51, thickness of the layer 52 and material of the rubber layer 52 are determined before assembling the fixing device and an upper limit temperature of the core 51, at which the rubber layer may not peel off the core, is estimated on the basis of the above-mentioned data. After assembling the fixing portion II, first preset temperature $T_1$ is determined by measuring the heating roller surface temperature when the heating roller core temperature reaches the upper limit temperature that, therefore, shall be predetermined with a due safety factor.

When the color image forming device is switched ON, the heater lamp 53 is turned ON and then works being continuously supplied with power. As described before, a constant voltage power is continuously supplied to the heater lamp 53 through the heater driving circuit 43 until the heating roller 50 is heated up to the first preset temperature at which the boundary surface temperature of the roller core 51 does not exceed its upper limit temperature, e.g., 180° C. Namely, the heater driving circuit 43 supplies power to the heater lamp 53 recognizing an output of the comparator circuit 47 showing that a temperature T detected by the temperature sensor 54 is lower than the first preset temperature $T_1$.

The heating roller 50 can rapidly elevate its surface temperature being continuously heated by the heater lamp 53. This may shorten the time of temperature rising to a target (second preset) temperature. The heating roller 50 and the pressure roller 60 are driven in rotation synchronously with turning on the power supply of the heating lamp 53.

As soon as the comparator circuit 47 detects that the surface temperature of the heating roller 50 reached the first preset temperature $T_1$ (e.g., 134° C.), the heater driving circuit 43 drives the heater lamp 53 according to an ON-OFF ratio stored in the table 46. In this instance, the ON-OFF ratio is predetermined in such a way that a temperature of the core 51 may not exceed the predetermined upper limit temperature but be stabilized thereabout. In case of controlling the heating lamp with the ON-OFF ratio of smaller than 1 for elevating temperature from the first preset temperature $T_1$, heat supplied to the heating lamp may not be excessive and gradually elevate the surface temperature of the heating roller 50, keeping a temperature of the core 51 near below the upper limit temperature.

In the above-mentioned case, the ON-OFF ratio may be, for example, such as to turn on the heater lamp for 1 second, turn off it for 3 seconds and thereafter repeat the same cycle. The ON-OFF ratio is 1/3 that is smaller than 1. The proportion of ON duration is 1/4 if the proportion of ON duration for continuous operation of the heating lamp is taken as 1.

Figure 15:
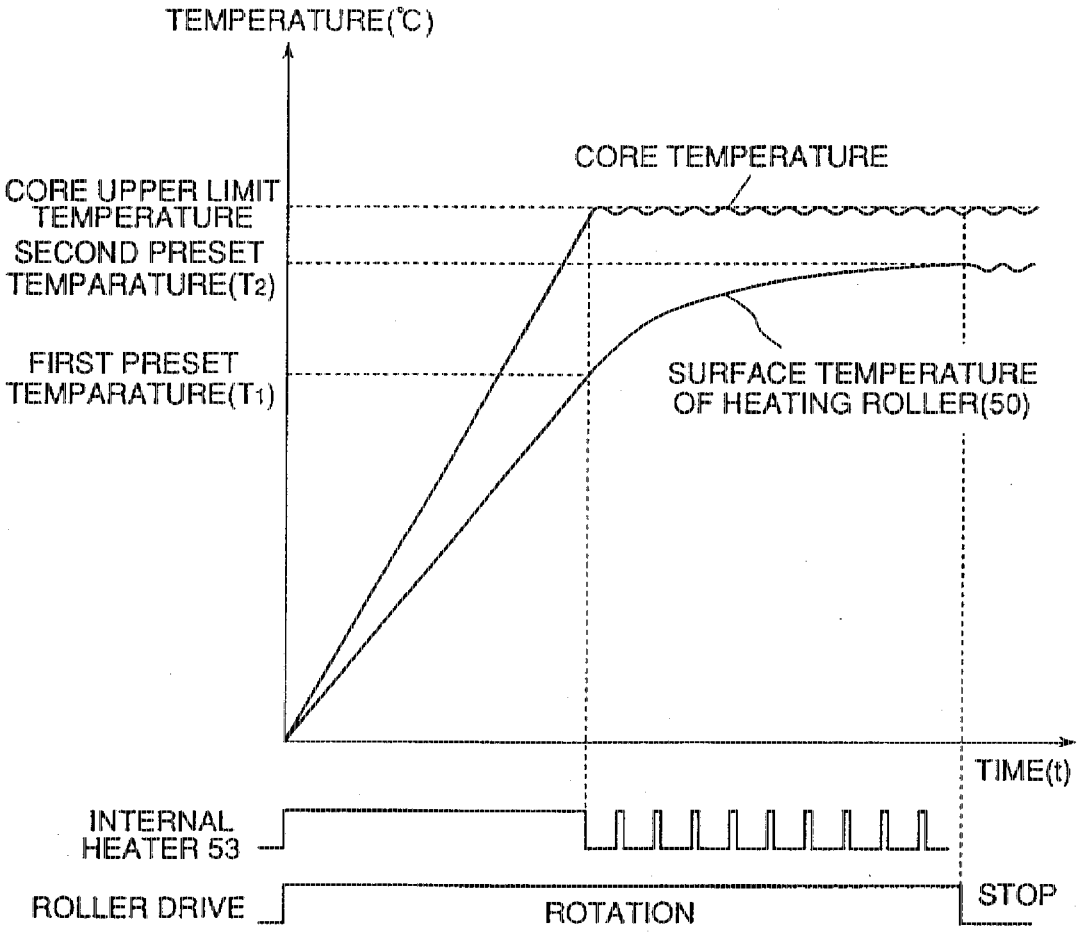
FIG. 15 is a time chart showing a relationship between a core temperature and a surface temperature of a heating roller for a temperature rising time with control.

The above-described conditions are shown in detail in FIG. 15. After the heating roller 50 was continuously heated by the heater lamp 53 to the first preset temperature $T_1$, the heater driving circuit 43 drives the heating lamp 53 repeatedly at the ON-OFF ratio stored in the table 46. Consequently, the heating roller 50 can gradually increase its surface temperature without causing the core 51 to be heated over the upper limit temperature To.

Accordingly, the surface temperature of the heating roller 50 gradually rises from the first preset temperature $T_1$. In this stage, the surface temperature of the core 51 reaches the upper limit temperature of, e.g., 175° C. but does not exceed said temperature. The above-mentioned power (drive) control causes the heater lamp 53 to heat the rubber layer 52 through the core 51. There may be some ripples but the core temperature can not increase over the upper limit temperature. The rubber layer 52 is heated such as to gradually elevate the surface temperature of the heating roller 50. Finally, the surface temperature of the heating roller reaches the second (target) preset temperature $T_2$ enough to fix a toner image onto a paper sheet. When the target temperature was detected by the temperature sensor 54, the power supply circuit of the heater lamp 53 is turned off and, at the same time, paired rollers 50 and 60 of the fixing portion II stop rotation.

The color image forming device is ready to work after the heating roller 50 has been heated to the second preset temperature $T_2$. When a start command is given, the device starts image forming process, driving processing drums and rollers.

Figure 16:
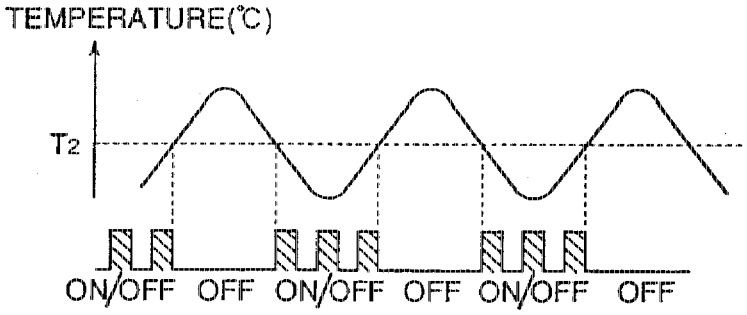
FIG. 16 is a time chart showing a control of electric power supply for maintaining a suitable fixing temperature after obtaining said temperature by the fixing device of FIG. 14.

After the heating roller has been heated to the second preset temperature $T_2$, the power control of the heater lamp 53 is effected to maintain the heating roller surface temperature at said target level by driving the heater lamp 53 according to a detection signal from the temperature sensor 54. FIG. 16 is a time chart showing an example of the power control of the heater lamp 53 in said stage. When the surface temperature of the heating roller 50 dropped below the second preset temperature $T_2$, the heater lamp 53 is driven to recover the target temperature of the heat roller 50. In this instance, the heater lamp 53 is repeatedly driven at a predetermined ON-OFF ratio until the heating roller 50 is heated to the second preset temperature $T_2$. The boundary surface temperature of the heating roller core 51 can be kept at the level not causing the rubber layer 52 to peel off the core. Consequently, the heat roller 50 may be used for a long period with no trouble with its core 51 and rubber layer 52.

When an image-forming starting command is given, the fixing portion II starts rotation of its paired rollers 50 and 60 before a sheet of paper 40 reaches thereto. As shown in FIG. 14, the surface temperature of the heating roller 50 may temporarily drop because heat of the heating roller is absorbed by the pressure roller 60. The heating roller, therefore, shall be heated to recover the target temperature. This recovery is achieved by driving the heating lamp 53 at a different ON-OFF ratio (second ON-OFF ratio) that is also prestored in the table 46.

The second ON-OFF ratio used for driving the heater lamp 53 at the beginning of image-forming process must be such as to compensate for the heat absorbed and to be absorbed by the pressure roller 60 and, therefore, to have larger proportion of ON-duration as compared with the first ON-OFF ratio used for control of the heater lamp 53 after attaining the first preset temperature $T_1$. In practice, ON-duration is constant and OFF-duration is shortened.

The first ON-OFF ratio used for elevating the heating roller temperature after reaching the first preset temperature and for maintaining the target temperature in waiting state after reaching the second preset temperature is 1:3 (1 sec. ON and 3 sec. OFF). Therefore, the second ON-OFF ratio may be, for example, 1:2. Namely, the proportion of ON-duration of the second ON-OFF ratio is 1/3 that is larger than that (1/4) of the first ON-OFF ratio. The second ON-OFF ratio may increase electric power to be supplied to the heater lamp 53, thereby heat value to be supplied is increased.

As a result of this, the heat absorbed by the pressure roller 60 and the heat necessary for maintaining the heating roller 50 at the second preset temperature $T_2$ can be covered. If the pressure roller 60 was rotated and heated to a certain degree at the stage of turning ON the power supply for elevating the heating roller temperature, it may not absorb so much heat from the heating roller 50 at the beginning of the image forming process. In this case, the first ON-OFF ratio instead of the second ON-OFF ratio can be applied for maintaining the target temperature $T_2$ of the heating roller at the beginning of the image forming process.

If the paired rollers 50 and 60 of the fixing portion II did not rotate when turning on the power supply for elevating the heating roller temperature, the pressure roller 60 may absorb much amount of heat. In this case, the second ON-OFF ratio (with an increased proportion of ON-duration) is effective to compensate the heat.

In the color image forming device, the paired rollers of the fixing portion II have rotated and the heating roller 50 has enough recovered its temporarily dropped temperature to the second preset temperature $T_2$ before a paper sheet 40 carrying a toner-developed image from the image forming portion I reaches the fixing portion II. The increased proportion of ON-duration of the heater lamp may not supply excessive heat because the paper sheet 40 absorbs heat from the heating roller 50. Consequently, the core 51 can not be heated over its upper limit temperature. The heating lamp 53 can be driven with an optimal amount of electric power without excess power.

The paper sheet 40 is guided into a path between the paired rollers 50 and 60 which fixes the toner image onto the paper sheet 40, giving a considerable amount of heat to the toner and paper. Consequently, the surface temperature of the heating roller 50 decreases. In this case, the heater lamp 53 is supplied with electric power enough to compensate for the heat transferred to the paper sheet 40 because the heater lamp 53 is operated at the second ON-OFF ratio (with an increased proportion of ON-duration as compared with that of the first ON-OFF ratio for waiting stage).

Accordingly, the heater lamp 53 is driven at the second ON-OFF ratio from the beginning of an image forming (printing) process and it is driven at the first ON-OFF ratio (for waiting stage) from the moment of stopping the rollers 50 and 60 of the fixing portion II at the end of the printing process. In both cases, the ratio of ON-duration to OFF duration must be set not to exceed 1:1 (less than 1) to prevent the core 51 from being heated over the upper limit temperature.

Changing the ON-OFF ratio is effected by shortening only OFF-duration in particular. By doing so, the memory capacity of the table 46 can be effectively saved. Namely, only OFF-duration is stored in the table because the ON-duration is constant. It is also possible to increase only ON-duration at a constant OFF-duration.

In this instance, an ON-OFF repetition period for driving the heater lamp 53 is long and, therefore, a temperature ripple may be large. Reducing the repetition period is very effective to reduce a temperature ripple. For this reason, it is better to shorten OFF-duration because the period can be shortened.

The ON-OFF ratio can control electric power to be supplied to the heater lamp 53. In case of supplying a voltage of a constant period, power can be changed by changing a voltage value or a current value at the turning-on (supply) moment of a constant period. This is the same with that ON-OFF ratio is replaced with time and voltage or current is changed. Therefore, control of ON-OFF ratio includes control of a current value or a voltage value besides the described example of control.

If printing process did not start within, e.g., 2 minutes of waiting time, the fixing portion II enters into an energy-saving mode in which electric power to be supplied to the heater lamp 53 of the fixing portion II is reduced for saving the electric energy and, at the same time, the fixing portion II is preheated for making the image-forming device be ready to work in a short time. This is also a preheating mode for preheating the fixing portion II with maximally saved electric energy.

In this case, the surface temperature of the heating roller 50 may be set to a temperature of, e.g., 100° C. (lower than the preset temperatures $T_1$ and $T_2$) and electric power necessary for maintaining said temperature is supplied. The proportion of ON-duration for the heating roller 53 is set to 1/N (N>10). For example, the power consumption of the heater lamp 53 is about 800 W (at ON). The ON-OFF ratio of 1:3 is selected to supply electric power corresponding to 25 W to the heater lamp 53. Namely, the heater lamp 53 is turned on for 1 second and turned off for 31 seconds and, thereafter, the same on-off cycle is repeated. A total power consumption is about 25 W since the proportion of ON-duration is 1/32. Accordingly, suitable selection of the above-mentioned proportion of ON-period may maintain the desired surface temperature Tp (e.g., 100° C.) of the heating roller 50.

The provision of a heater lamp of about 25 W for use in the energy-saving mode in addition to the heating lamp 53 may easily realize the above-mentioned control of keeping a temperature of the heating roller 50 at about 100° C. As described above, one heating lamp 53 can be easily used in the energy-saving mode by selecting a suitable ON-OFF ratio, eliminating the need of using a special heat lamp and thereby simplifying the assembly of the fixing portion II.

Although the fixing portion II in the shown example may automatically enter into the energy-saving mode if the device is left in waiting state (image forming device is ready to work) for more than 2 minutes, it is of-course possible to set any desired waiting period. A special key may be provided for setting energy-saving mode.

Cancelling the energy-saving mode is effected by using a specially provided mode-releasing key. When the energy-saving mode is released, the fixing portion II drives the rollers 50 and 60 into rotation and turns on the heater lamp 53. The heater lamp 53 is operated not at the first ON-OFF ratio but in the continuous operating mode. When the heating roller is heated to the first preset temperature T1, the heater lamp 53 is thereafter operated at the first ON-OFF ratio. The temperature of the core 51 can be always kept below the upper limit temperature not causing the layer 52 to peel off the core 51.

The heating roller 50 can elevate its surface temperature to the second preset temperature $T_2$ in a very short time because it was preheated to the temperature Tp of, e.g., about 100° C. The heating roller 50 can be surely heated to the second preset temperature $T_2$ within a period that a print start signal is generated, an image-forming process starts and a paper sheet 40 carrying a toner image thereon reaches the fixing portion II. The printing may be conducted immediately without waiting.

Therefore, the energy-saving mode may be cancelled not only by manual operation of the cancelling key but automatically according to the print starting signal generated in response to the print switch operation. The surface temperature of the heating roller 50 in the energy-saving mode may be preset to the value from which the heating roller 50 can enough elevate its temperature to the second preset temperature until a first sheet of paper 40 reaches the fixing portion II.

A toner image fixing device according to the present invention is capable of effecting heat control for maintaining a surface temperature of a heating roller at a temperature necessary for fixing toner with no fear of causing rubber layer to peel off the heating roller core. This feature assures a prolonged service life of the fixing device itself.

In the fixing device, a pressure roller can be also heated by previously rotating it with the heating roller. This feature may minimize a heat loss of the heating roller in fixing a toner image and, thereby, may keep the heating roller at a preset temperature with a saved power supply, preventing the rubber layer from peeling off the heat roller core.

Electric power is effectively supplied to a heat source, eliminating the possibility of overheating the heating roller by an excess heat and increasing an effect of preventing peeling-off of rubber layer of the heating roller core.

Because electric power is supplied to compensate the calorific power consumed by the image carrying medium from the beginning of an image forming process, the heating roller can be always kept at a suitable fixing temperature, preventing the laminated layer of the roller core from peeling off and assuring reliably fixing the toner image onto the medium.

With the toner image fixing device according to the present invention, a heating roller surface temperature can be controlled to minimize its ripple components, achieving stabilized process of fixing a toner image.

Figure 17:
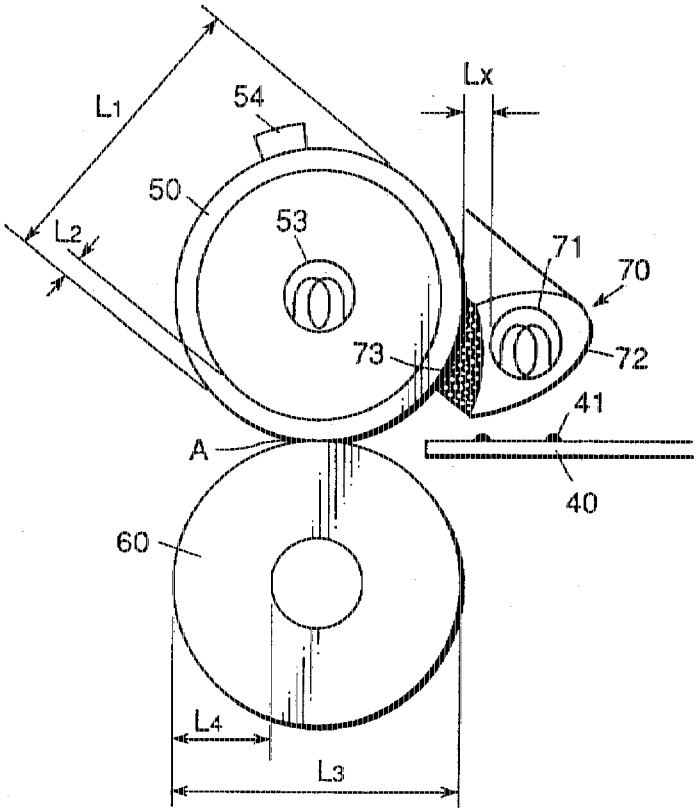
FIG. 17 is a view for explaining an example of a toner-image fixing device embodying the present invention, which uses a heater lamp with a reflecting cover as an external heater.

FIG. 17 is a schematic construction view of a toner image fixing device embodying the present invention. In FIG. 17, there is shown a toner carrying material (recording medium) 40, an unfixed toner 41 on the toner carrying material 40, a roller (fixing roller) 50 to come in contact with the unfixed toner 41, a halogen lamp 53 being an internal heating means disposed in the fixing roller 50, a temperature sensing element (e.g., a thermistor) 54 for sensing a temperature of the fixing roller 50, a pressure roller 60 cooperating with the fixing roller 50 to nip the recording medium 40 and an external heating means 70 for heating the toner 41 and/or heating the fixing roller 50. The external heating means 70 consists of a heating element 71, a reflector 72 for reflecting heat radiation from the heating element 71, a net-like filter 73 and so on. The heating element 71 may be a heater such as a plane heating element, ceramic heater, xenon lamp, self-control heating element and PTC ceramic heater. Construction and advantage of each heater will be described later.

As described above, the fixing device according to the present invention uses the heating element 71 as an external heating means disposed near the outside of the fixing roller 50 and a halogen lamp 53 as an internal heating means disposed in the fixing roller 50 to heat up the fixing roller to a temperature suitable for fixing toner 41 onto a recording medium 40. The fixing roller 50 is provided with a temperature sensing means 54 (e.g., a thermistor) for detecting a surface temperature of the fixing roller 50 and a system for adjusting heat radiation of the internal heating means 53 and the external heating means 70 to control the surface temperature of the fixing roller 50 to a desired temperature.

The external heating means 70 consists of a heater lamp 71 provided with a reflector 72 for directing radiant heat from the heater lamp 71 toward a nip portion A formed between the heating roller 50 and the pressure roller 60. This may effectively heat the heating roller by shortening a time for cooling the roller with the surrounding air. The external heating means 70 is located at the end of a revolution track of the heating roller from the nip portion A through a cleaner and an oiling unit. This arrangement may prevent a paper sheet from arriving at the external heating means 70 by the cleaner and the oiling unit even if the paper sheet is offset and wound round the heating roller body. The safety work of the device is thus assured.

Figure 18:
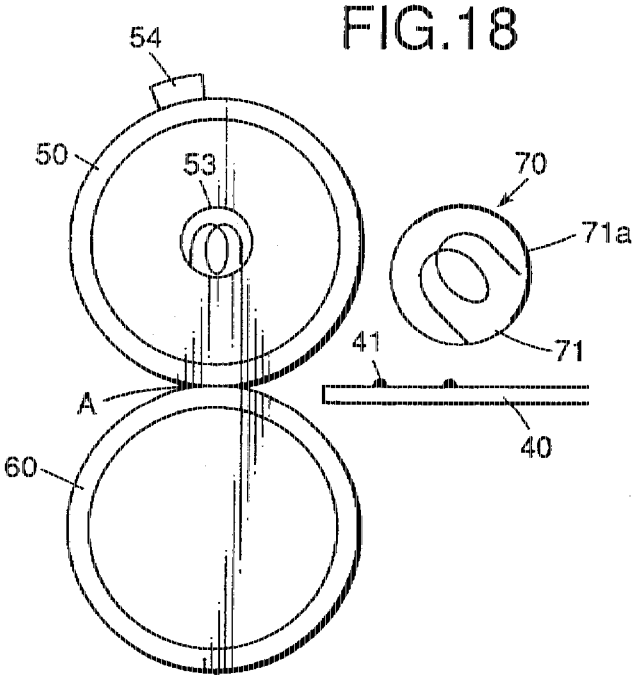
FIG. 18 is a view for explaining an example of a toner-image fixing device embodying the present invention, which uses a heater lamp containing a reflecting film as an external heater.

FIG. 18 is a schematic construction view of another toner image fixing device embodying the present invention. In FIG. 18, parts similar in function to those of the embodiment shown in FIG. 17 are given the same numerals. In this embodiment, a heater lamp 71 is internally covered with a reflecting film 71*a* that may converge radiant heat to the vicinity of the nip portion A of a heating (fixing) roller 50 with a pressure roller 60 without using reflector 72 of FIG. 17. This eliminates a problem with the reflector 72 that may be overheated.

Figure 19:
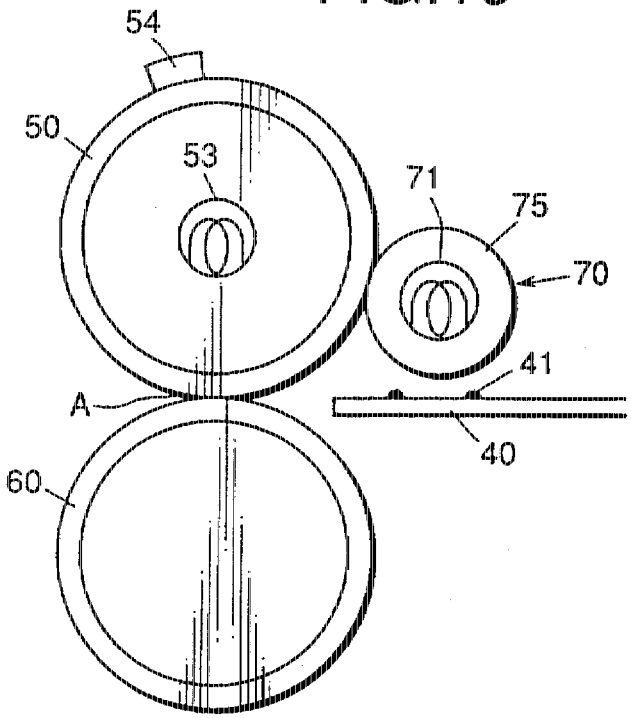
FIG. 19 is a view for explaining an example of a toner-image fixing device embodying the present invention, which uses a contact type cylindrical roller containing a heater as an external heater.
Figure 20:
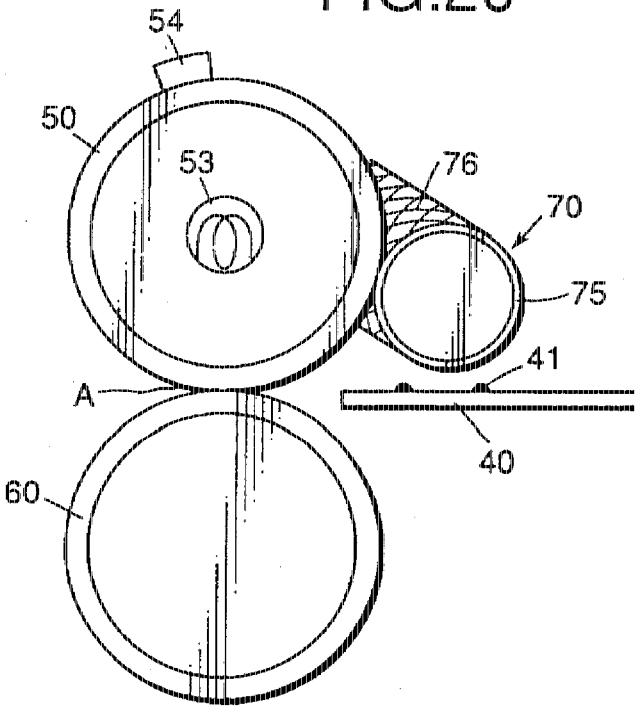
FIG. 20 is a view for explaining an example of a toner-image. fixing device embodying the present invention, which uses, as an external heater, a contact type cylindrical roller having a heater element formed on its cylindrical surface.

FIGS. 19 and 20 are schematic construction views of other toner image fixing devices which parts being similar in function to those of the embodiment of FIG. 17 are given the same numerals. In these embodiments, an external heating means 70 is a roller that is slidable on a fixing roller 50 contacting with toner on a recording medium 40. The embodiment of FIG. 19 uses the metal-made cylindrical roller 75 incorporating a halogen lamp and slidably contacting with the roller 50, while the embodiment of FIG. 20 uses a cylindrical roller 75 having a heating element 76 formed on the external cylindrical surface thereof.

In the above-mentioned embodiments of the present invention, heating toner and/or fixing roller is heated by the external heating means 70 in such a manner that paired rollers 50 and 60 are always rotated while the external heating means is ON. In other words, switching ON of the heating means 70 is interlocked with rotation of the paired rollers to eliminate the possibility of locally overheating the roller surface that may cause firing in the device. The heater can be switched OFF as soon as the roller stops or urgently stops due to paper jamming.

In case of using the external heating means of FIG. 17, which concentrates radiant heat from the lamp 71 onto the nip portion A between the heating roller 50 and the pressure roller 60 by using a reflector 72, experiments were conducted by changing a distance from the heating roller 50 to the external heating means 70 to transfer the most heat to the roller without contacting the latter with paper. The experiment results are shown in Table 1. As Table 1 demonstrates, a suitable distance from the external heating means 50 to the surface of the heating roller is within 3 mm to 10 mm. The data of Table 1 was obtained by the experiments which were conducted taking a parameter of a distance Lx from the surface of the heating roller 50 to the external heater 71 on the conditions that the heating roller 50 has an outer diameter $L_1$ of 30 mm and a wall thickness $L_2$ of 1.0 mm, the pressure roller 60 has an outlet diameter $L_3$ of 30 mm and a wall thickness $L_4$ of 5.5 mm, the external heater 71 has an output power of 550 W and the internal heater 53 has an output power of 250 W.

TABLE 1

| Distance Lx from Roller Surface to External Heater | Rising Time | Notes |
|---|---|---|
| 2 mm | | The construction did not allow measurement. |
| 3 mm | 98 sec. | Good |
| 5 mm | 120 sec. | Good |
| 8 mm | 155 sec. | Good |
| 10 mm | 178 sec. | Maximum permissible rising time. |
| 13 mm | 216 sec. | Low efficiency of the external heater |

The heating efficiency of the external heating means 70 can be improved by disposing it near the inlet of a passage for paper sheet without disposing therebetween any device, e.g., an oiler that may absorb radiant heat. A net-like filter 73 disposed between the external heating means 70 and the heating roller 50 is intended to prevent a jammed paper sheet from being burnt in contact with the heater.

The heating roller 50 that comes into contact with toner 41 on the recording medium 40 incorporates a heater 53 to be used as the internal heating means. The roller 50 is a roller covered with thin rubber, which incorporates the internal heater 53 or is provided with the external heater 71. The pressure roller 60 with no heating means is covered with a silicone rubber or sponge layer with a PFA tube to improve its thermal insulation. The combination of thus constructed rollers minimizes a heat loss of the heating roller 50 and saves a rising time.

In the above-mentioned arrangement of the external and internal heaters, the external heater 71 is supplied with electric power more than 50% of total electric power of the fixing device so as to enable the external heater 71 to quickly compensate a drop of the surface temperature drop of the fixing roller 50 that may occur while recording paper with a toner image passes therethrough. This assures a high-quality of the fixed image on the paper.

Figure 21:
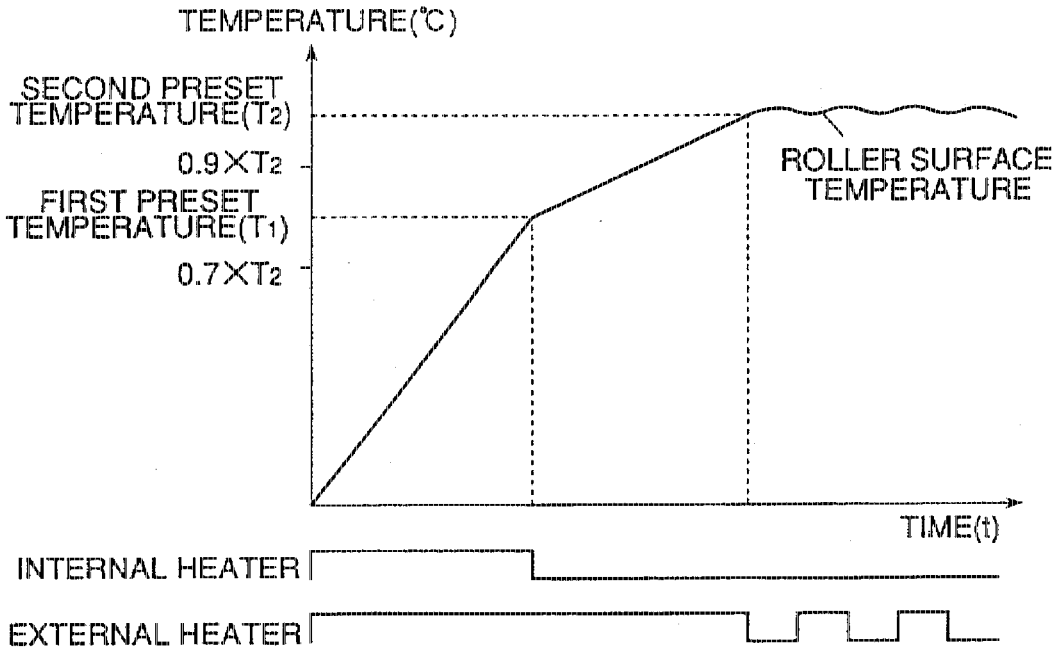
FIG. 21 is a view for explaining an example of temperature control method for control a surface temperature of a fixing roller to a second preset temperature suitable for fixing a toner image on a recording medium by using a combination of an external heater and an external heater.

An example of a temperature control method according to the present invention is as follows:

Both the external heater 71 and the internal heater 53 are switched ON to heat the working surface of the fixing roller 50. Because the core boundary temperature of the roller 50 must be limited, for example, not higher than 180° C., the internal heater 53 is switched OFF as soon as the roller surface temperature reached 150° C. (the first preset temperature $T_1$), and, thereafter, only the external heater 71 is used for further heating the roller surface as shown in FIG. 21. The first preset temperature ($T_1$) must be determined in such a manner that the roller 50 may be heated by the external heater to get a second preset surface temperature $T_2$ on the condition that its core boundary temperature may reach the upper limit temperature 180° C. at which rubber coat still can not strip off the core. It must be taken into consideration that the core boundary temperature of the roller 50 can increase after the internal heater 53 is switched OFF at the first preset temperature. The above-mentioned first preset value $T_1$ (150° C.) is selected on the basis that the surface temperature of the roller 50 heated by both the internal heater 53 and the external heater 71 was measured at 154° C. when the core temperature was measured at 160° C.–170° C. (particularly at 165° C.). The roller 50 was heated by the external heater 71 only to the second preset temperature $T_2$ and, at the same time, its core temperature reached to the upper limit temperature 180° C. at which the rubber can not strip-off from the core.

Figure 22:
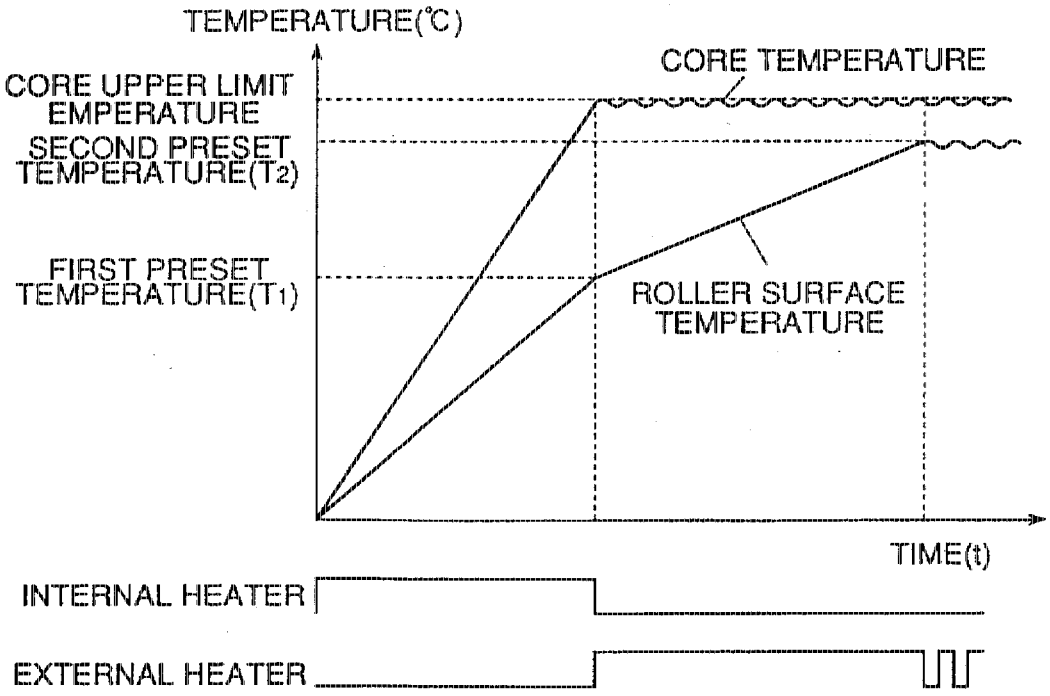
FIG. 22 shows a change of surface temperature of a roller arid a change of its core rod when they are heated by using an internal heater and an external heater.

FIG. 22 shows another temperature control method whereby only the internal heater 53 works first to heat the roller 50 until the latter gets a first preset temperature $T_1$ (an upper limit temperature, at which the rubber can not strip-off from the core), the internal heater 53 is turned off and the external heater 71 is switched on to heat the roller 50 thereafter to a second preset temperature $T_2$. This method adopts the first preset temperature of 128° C.

On the basis of the above-mentioned experiment results, the first preset temperature $T_1$ is desirable to be within the range of 70% to 90% of the second preset temperature $T_2$. By doing so, the roller 50 can be heated only the external heater 71 from the first preset temperature to the second temperature for a short time, preventing the roller core from being heated over the upper limit temperature.

TABLE 2

| | Roller surface temperature at which an inner heater is switched off not to allow the roller core temperature to increase over the upper limit temperature | Portion of the left-mentioned temperature relative to the second preset value (175° C.) |
|---|---|---|
| Heating by an internal heater only | 128° C. | 73% |
| Heating by both internal and external heaters | 154° C. | 88% |

After the surface temperature of the roller 50 reached to 175° C. (the second preset temperature $T_2$), the temperature control is effected to always maintain the roller surface temperature at 175° C. (the second preset temperature $T_2$.

Figure 23:
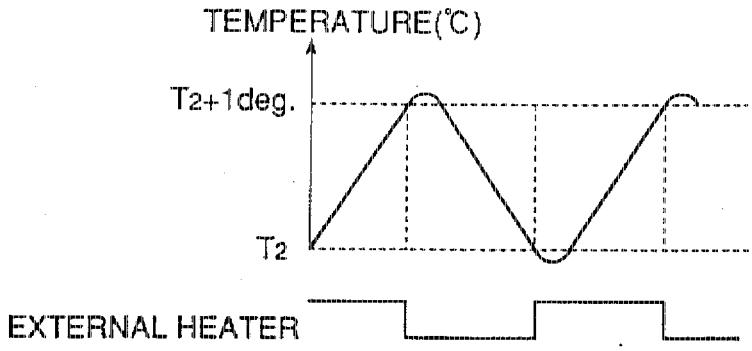
FIG. 23 shows a change of surface temperature of a roller by on-off controlling an external heating means.
Figure 24:
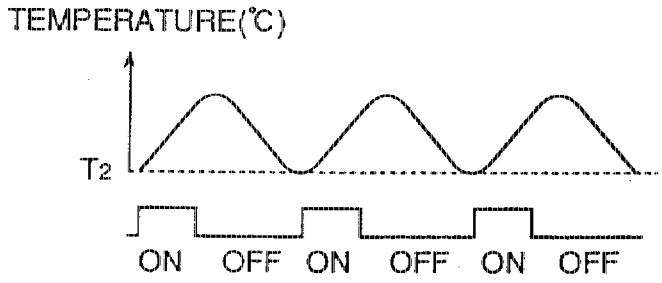
FIG. 24 shows a change of surface temperature of a roller by on-off proportional controlling an external heating means.

The constant temperature control is realized by such a method that switches ON the external heater at 175° C. ($T_2$) and switches OFF the external heater at 176° C. ($T_2$+1 deg.) as shown in FIG. 23 or which operates the external heater to be switched ON and OFF at a specified proportion to maintain the temperature at 175° C. after the roller surface temperature reached 175° C. ($T_2$) as shown in FIG. 24.

Figure 25:
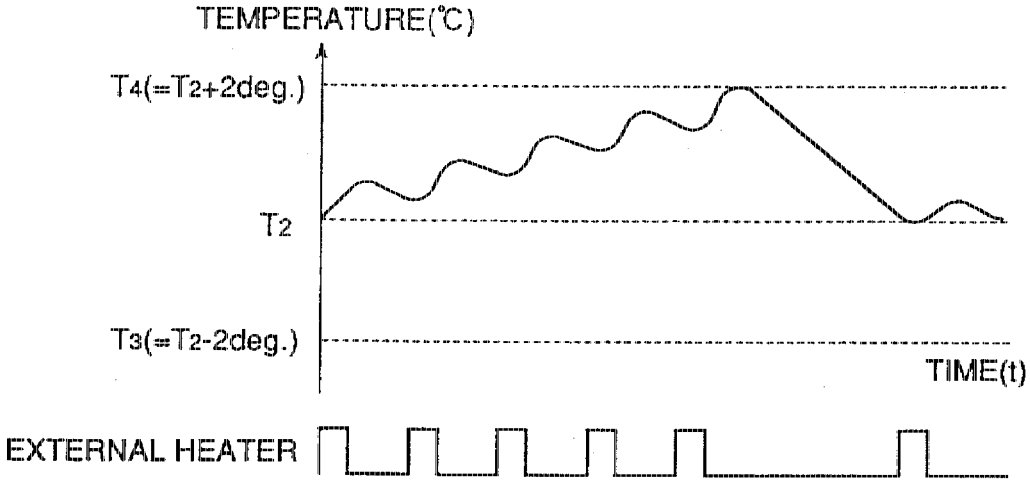
FIG. 25 is a view for explaining a temperature control method for rising or lowering a roller surface temperature by changing on-off ratio and surroundings of an external heating means.

In this instance, a temperature ripple can be suppressed by setting a third preset temperature ($T_3$) at a value corresponding to the second preset temperature ($T_2$) −2° C. to −3° C. and a fourth preset temperature ($T_4$) at a value corresponding to the second preset temperature ($T_2$) +2° C. to +3° C. as shown in FIG. 25. For example, no temperature ripple occurs when the external heater is controlled to be turned ON at a roller-surface-temperature of 173° C. (the third preset temperature $T_3$) and to be turned OFF at 177° C. (the fourth preset temperature $T_4$).

In viewing of using a power saving control mode (preheating mode to lower the surface temperature of the heating roller of the fixing device to a temperature at which toner fixing can not be effected or using power saving switch for a paused time of the fixing device, thereby warming-up time may be shortened), the internal heater is always supplied with a preheating electric power of, e.g., 20 W to 30 W (25 W for the described embodiment) after switching on the power source. This makes it easier to control the surface temperature of the heating roller.

In this case, the external heater may be supplied with electric power that is determined by reducing the electric power supplied to the internal heater from a total electric power supplied to the fixing device. For example, an electric power of 775 W is distributed to the external heater if the total power supply is 800 W. The above-described temperature control is effected by using the external heater.

A similar effect can be obtained by controlling calorific value of the external heater by changing an electric power (particularly, voltage) to be applied to the external heater at every preset temperature of the fixing roller. Namely, the calorific value can be adjusted through the electric power control by changing a voltage or power-supplying duration.

Figure 26A:
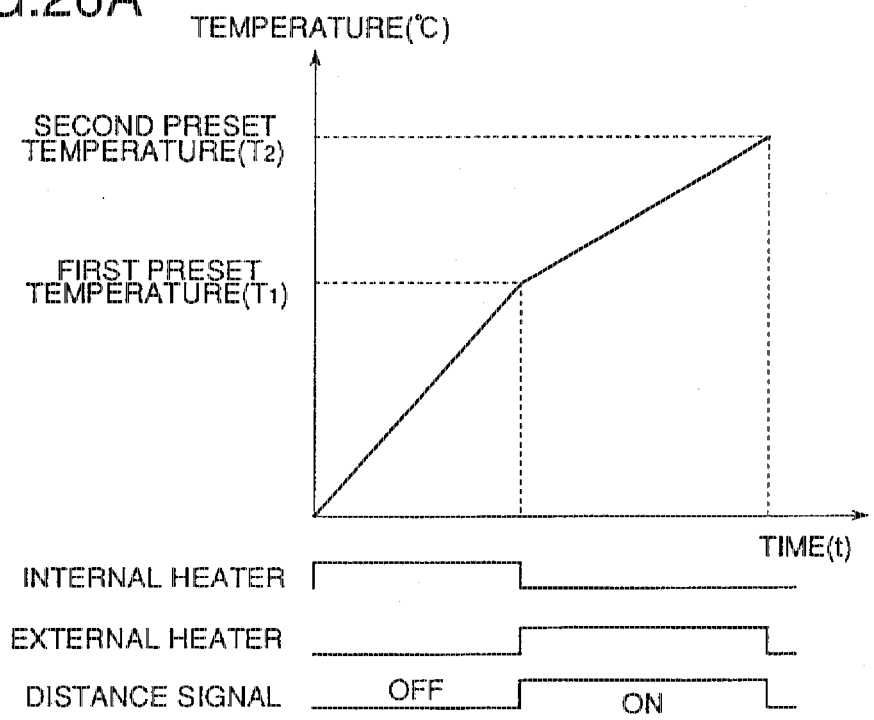
FIGS. 26A and 26B are timing diagrams of periodically separating a pressure roller from a fixing roller to control a surface temperature of the fixing roller to a second preset temperature suitable for fixing toner by using a combination of an internal heating means and an external heating means.

FIG. 26A shows another example of a roller-surface-temperature control method that operates only an internal heater to heat the roller to its first preset surface-temperature ($T_1$) of e.g., 125° C. at which its core temperature reaches the upper limit temperature of 180° C., turn off the internal heater and turn on an external heater to heat the roller further to a second preset surface-temperature ($T_2$) and turn on an external heater to 175° C.

Figure 26B:
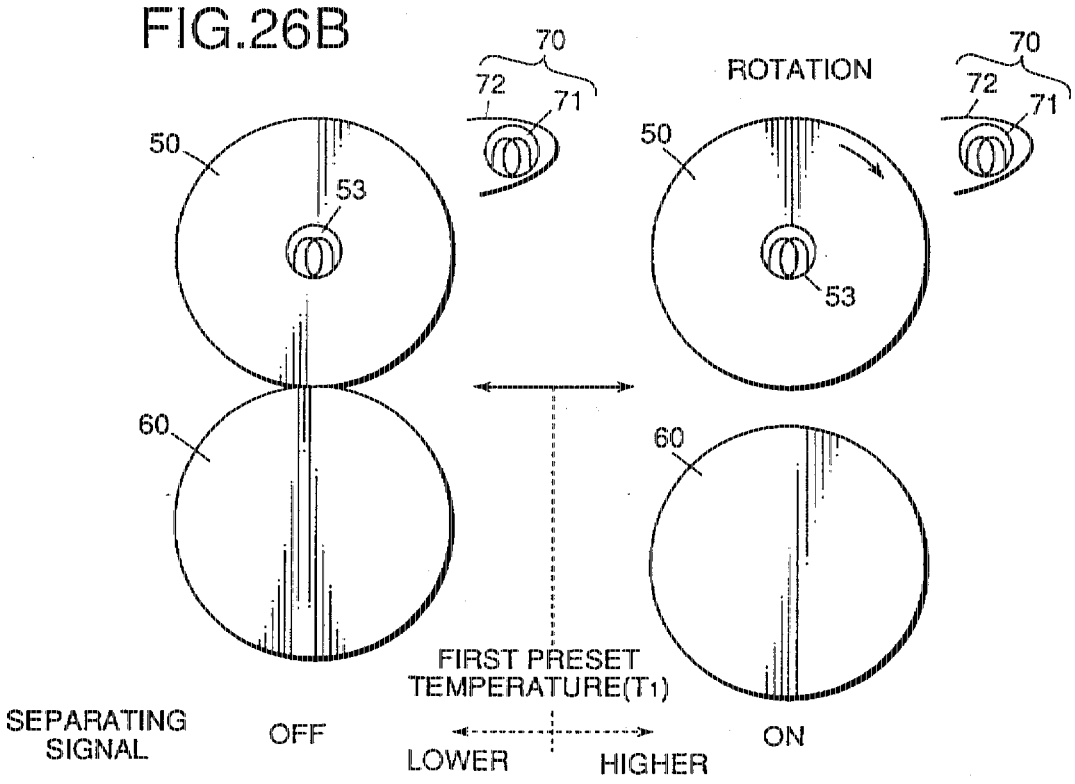

In this instance, at the first preset temperature ($T_1$), the internal heater 53 is turned off and the external heater 71 is turned on, simultaneously separating the paired rollers 50 and 60 from each other and rotating only the heating roller 50 as shown in FIG. 26B. The rollers are released into contact with each other to fix by fusing a toner image onto a recording medium. This can save the rising time of the heating roller because no heat can be transferred from the heating roller to the pressure roller while they are separated from each other.

The pressure roller 60, which has no heating means and rotates in contact with the heating roller 50, is covered with a silicone rubber or sponge with a PFA tube to improve its thermal insulation. Namely, heat can be effectively transferred to the recording paper whereon a toner image can be effectively fixed. In this case, a thin rubber of the roller 50 can quickly attain the second preset temperature $T_2$ by the external heater and the internal core heated to 180° C. before switching off the internal heater 53. This method can prevent the roller core from being heated over the upper limit temperature of 180° C.

Constructional advantages of the above-mentioned heaters are as follows:

A plane heater is a heating element (e.g., a nichrome wire) made in the form of a flat element which surface is covered with a coat of insulating material such as Teflon, polyimide and so on. The heater is desired to have a high insulation and smoothness of its surfaces. In applying in the embodiment of the present invention, the heater may be used in direct contact with the roller to be heated for achieving the most effective heat transmission or with a space of several millimeters from the roller surface.

A ceramic heater consists of an alumina ceramic substrate whereon flat heating resistance of MO system is printed and covered thereon with a glass coat. The ceramic heater can quickly raise its temperature to a specified temperature when supplied with electric power. It may be used at its heating surface disposed near to or in contact with the cylindrical surface of the roller to be heated.

A xenon lamp is a flash lamp filled with xenon gas, which produces radiant energy having a peak of wavelength of 566 nm with a high direct current applied across both end electrodes of the lamp. It has a high heating efficiency when externally heating the roller.

A self-regulating type ceramic heater is a ceramic heater that produces heat on the condition that a current produced therein with an applied thereto voltage does not exceed a specified value. This type heater, if made of suitable material, may maintain its surface temperature at a specified value when a specified voltage is applied thereto. The ceramic heater is disposed close to or in contact with the roller surface to be heated.

The paired rollers according to the present invention are intended to improve the quality of an image (in particular, color image) to be fixed on a recording medium. For this purpose, the roller that comes into contact with unfixed toner on the recording medium is covered with silicon rubber. The technical problems with which the rubber-covered rollers may encounter are (1) stripping-off of the rubber from the roller core surface due to temperature rising and (2) prolonged rising time.

Usually, the rubber is bonded to the aluminum core with adhesive called "primer" which has a heat resistance of not higher than 200° C. but in many cases can work only at a temperature up to 180° C. due to deterioration of its quality by the affection of oil contained. To fix a toner image onto the recording paper, it is necessary to maintain the roller surface temperature at a specified temperature and, at the same time, to secure a specified width of a contact surface (nip) between the paired rollers. These values to be preset depend upon a linear speed of an image-forming device and the properties of toner to be used. Normally, the roller surface temperature may rise near to 180° C. that corresponds to the practical heat resistance of the primer. Therefore, the surface temperature of the heating roller in the embodiment of the present invention must be preset to a value in a range from 165° C. to 175° C. Any prior-art fixing device that uses only a heating roller or rollers each incorporating a heating element (e.g., halogen lamp) and works with usual temperature control, however, can not maintain the primer portion (boundary between the rubber and the core of the roller) at a temperature not higher than 180° C. In view of the foregoing, the present invention was made to provide a fixing device that meets all requirements on the fixing quality, fixed image quality and rising time under the condition that the boundary surface temperature of the roller core shall be kept not higher than 180° C.

Target specification values of an image forming device to which the present invention may be applied are by way of example shown below:

(1) Temperature rising time: Not more than 3 minutes
(2) Rising time from the energy saving start mode: Not more than 1 minute;
(3) Fast copying time: 7.5 sec. for monochromatic copy, 22.5 sec. for 4-colors (YMCBk) copy
(4) Boundary surface temperature of the roller core: Not higher than 180° C.

Figure 27:
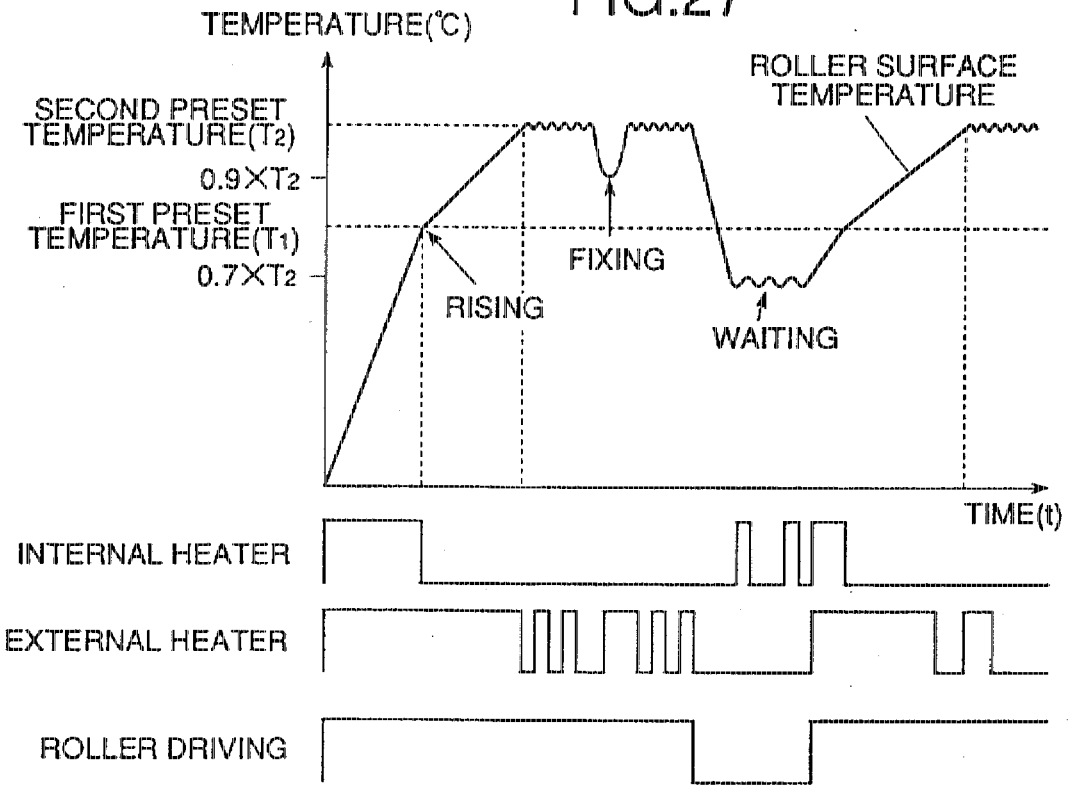
FIG. 27 shows a method of controlling a surface temperature of a roller and a change of temperature of the roller surface temperature.
Figure 28:
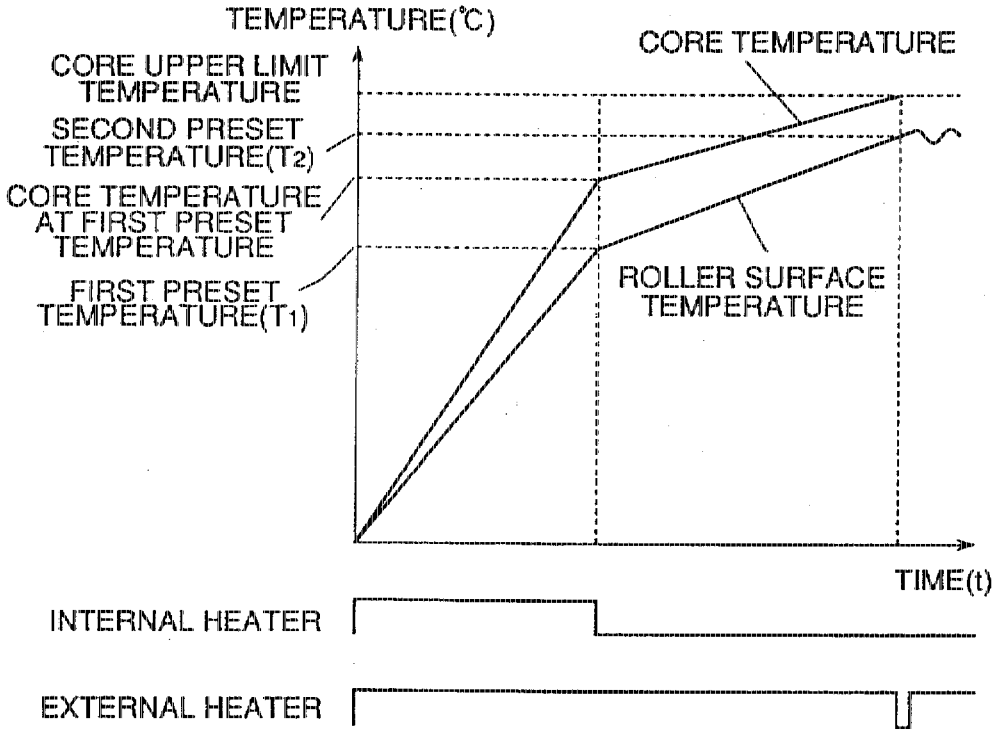
FIG. 28 is a diagram for determining a change of surface temperature of a fixing roller and its core and a first setting temperature when heating the fixing roller to a second preset temperature suitable for fixing toner by using a combination of an internal heating means and an external heating means.

FIG. 27 shows a characteristic curve of the surface temperature of the fixing roller when the temperature control is effected to satisfy the above-mentioned requirements. FIG. 28 shows characteristic temperature curves of the roller surface and the roller core surface when heating the heating surface to a second preset temperature by using a combination of internal and external heating means. An example is described as follows:

(1) Rising time

To fix a toner image onto a recording medium, the fixing roller (contacting with toner) must be heated to 175° C. at its working surface for a rising period of not more than 3 minutes. At this time, the core boundary surface must not exceed 180° C. Heating is effected by using a combination of the internal and external heating means. Because a heat flux from the external heating means is given externally to the working surface of the fixing roller, the boundary surface temperature of the roller core can not exceed the working surface temperature of the roller even with the full powered external heating means. On the contrary, a heat flux from the internal heating means is internally given and reaches the working surface of the roller. If the internal heating means is fully powered without due temperature control, there may arise such a fear that the boundary surface temperature of the roller core rises higher than the working surface temperature of the roller. For example, the core temperature exceeds 180° C. at the roller working-surface temperature of 175° C., resulting in peeling-off of the rubber from the roller core surface. Accordingly, the present invention provides the fixing device with such a temperature control system that uses both the internal and external heating means to heat the fixing roller for a period of rising time, turns off the internal heating means at a specified temperature and then operates the external heating means by turning off and on to heat and maintain the roller surface temperature at the target preset value (175° C.). In this case, the internal heating means is controlled to be turned off at a preset temperature lower than the preset target value of the roller surface temperature and is further operated by changing ON-OFF ratio. Namely, the internal heating means is operated with its full power to sharply elevate a roller surface temperature to 150° C. (for increasing the temperature rising rate) and is operated ON for a shortened duration and OFF for a prolonged duration to smoothly increase the roller surface temperature from 150° C. to 175° C. without rapidly increasing the surface temperature of the roller core.

(2) Fixing toner

In case of fixing multiple color toner on a recording medium, every color image may have a specified height of unfixed toner that requires a specified calorific heat for fusing the toner to obtain a high-quality toner image fixed on the recording medium. This may be achieved by change a preset value of heating surface temperature of a fixing roller for every color image. This method will be described later. In an image forming device to which a fixing device according to the present invention is applied, a sheet of paper with a color toner image formed thereon is fixed by paired rollers that must have a nip width of 5 mm and one of which (fixing roller) must be heated to 175° C. at its heating surface. The surface temperature of the fixing roller is detected by a thermistor disposed on the roller surface and a detected signal is feed backed to a temperature control system for controlling the internal heating means and the external heating means. As described before, the fixing roller is heated by using both the internal and external heating means until its surface temperature reaches 150° C., and then it is heated by using the external heating means to raise its surface temperature from 150° C. to 175° C. and further maintain its surface temperature at 175° C. The surface temperature of the fixing roller is desired to keep 175°±5° C. for obtaining a high-quality fixed toner image. This is achieved by conducting fine temperature control of the internal heating means at a roller surface temperature of about 175° C.

(3) Pause and Start in Energy Saving Mode

After the lapse of a specified period from the end of a preceding operation for fixing a toner image on a recording medium by the fixing device at a constant temperature (175° C.) of the fixing roller surface, the image forming device comes into an energy saving mode (also called "energy start mode" or "preheating mode"). This mode is such that limits a total power consumption of the image forming device to about 30 W with distributing about 25 W to the fixing portion. Accordingly, the surface temperature of the fixing roller is stabilized (in the steady state) at about 110° C. in the energy-saving mode. The condition for entering the device into the energy-saving mode can be set by a user. For example, it is possible to set the device to enter into the energy-saving mode after the elapse of 30 seconds of unused state of the device. Any desired pause can be preset. The surface temperature of the fixing roller is kept at 175° C. until the device enters into the energy-saving mode. The rollers rotate and the internal and external heaters being supplied with electric power are controlled at 175° C. and 150° C. respectively. When the device enters into the energy-saving mode, only the internal heater of 25 W works to maintain the roller surface temperature at about 110° C.

(6) Rising from the energy-saving mode

In the energy-saving mode, the surface temperature of the fixing roller of the fixing portion is maintained. at a steady-state temperature of about 110° C. and the surface temperature of the pressure roller in still state is kept at about 50° C. When the power supply is turned ON, the rollers rotate and the external heater and the internal heater are supplied with current. To heat the fixing roller surface to a temperature (175° C.) necessary for fixing toner for a short time without allowing the core temperature to exceed 180° C., it is needed to control the temperature rising process in such a way that both heater are operated with full power to heat the fixing roller surface to 150° C., the internal heater is turned off at the same temperature and only the external heater is operated thereafter to rise the surface temperature of the fixing roller from 150° C. to 175° C.

Figure 29:
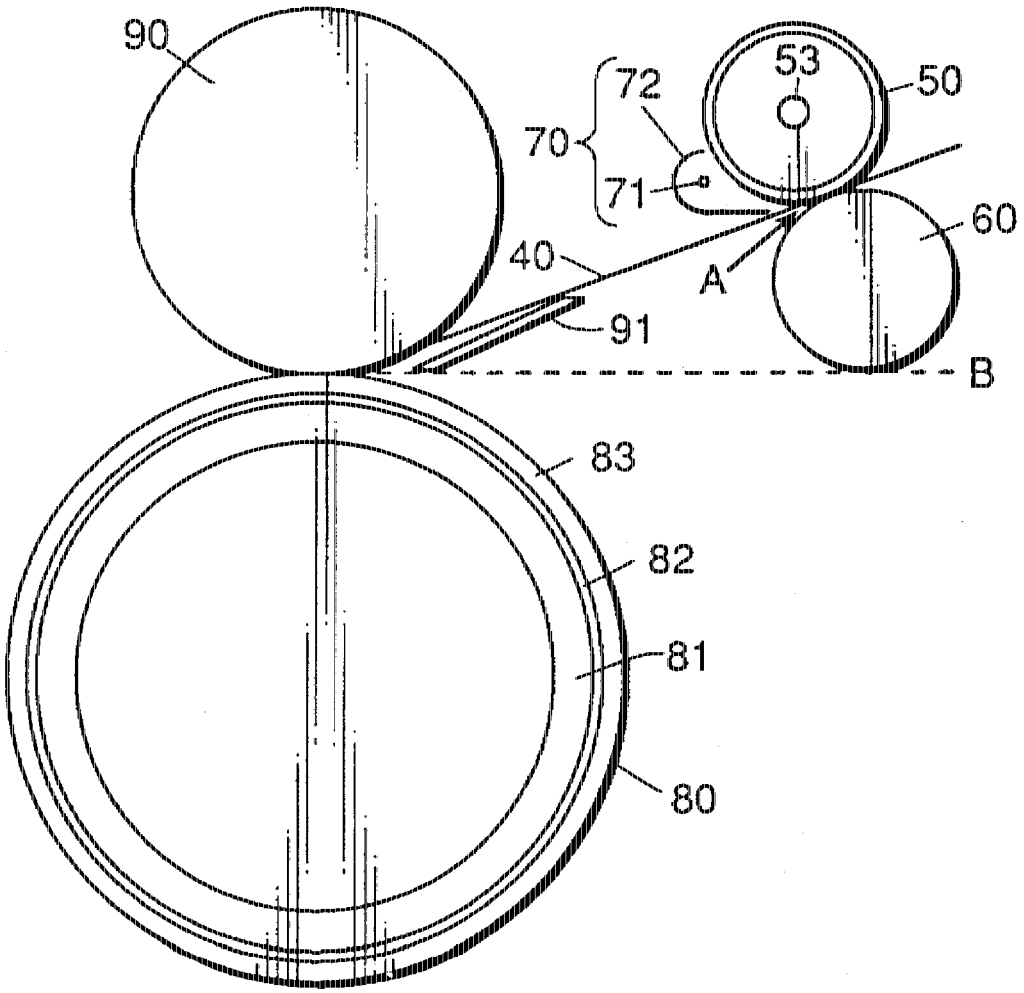
FIG. 29 is illustrative of a position correlation between a transfer roller and fixing roller in a fixing device according to the present invention.

FIG. 29 is a view for explaining relative positions of a toner-image transferring portion and a toner image fixing portion according to the present invention. As shown in FIG. 29, the fixing portion is disposed on the side of a light-sensitive drum 90 relative to a direction B perpendicular to a straight line passing the center of the light-sensitive drum 90 and the center of the toner-image transferring drum 80 consisting a core 81 covered with an inner layer 82 and an outer layer 83 (i.e., a tangential line direction B from a nip portion between the toner-image transferring drum 80 and the light-sensitive drum 90). A sheet of paper (toner image carrier) 40 delivered by a separator 91 from the toner-image transferring portion enters into a nip A between paired rollers (a toner-image side roller 50 and a back-up roller 60) and is subjected to fixing the toner image thereon by heat from an external heater 71 and an internal heater 53 under the contacting pressure of the paired rollers 50 and 60.

By arranging the nip portion A of the fixing portion on the side of the light-sensitive drum relative to the direction perpendicular to the straight line passing the centers of the toner-image transferring drum 80 and the light-sensitive drum 90, a toner image carrying sheet 40 can be normally send to the fixing portion without forcibly bending even if the front edge of the paper 40 is deflected to the side of the light-sensitive drum by pressing the latter against the outer layer of the toner-image transferring drum 80.

As is apparent from the foregoing, the toner fixing device according to the present invention offers the following advantages:

In an externally and internally heating type toner image fixing device according to the present invention, which comprises a pair of rollers through which a recording medium carrying an unfixed toner image formed thereon passes under a contact pressure, an internal heater disposed in at least one of said rollers and an external heater disposed opposite to a surface of the recording medium whereon the toner image formed, and which is intended for fixing the toner image onto the recording medium by using the internal heater and the external heater, both heaters are operated to heat the toner to a first preset temperature lower than the melting point of the unfixed toner and only the external heater is operated thereafter to heat and maintain toner at a second preset (target) temperature for fixing the toner image onto the recording medium, keeping the roller core temperature in the range that does not allow rubber layer to peel off from the core surface.

In an externally and internally heating type toner image fixing device according to the present invention, it is possible to rapidly raise a surface temperature of a fixing roller to a second preset (target) value since both internal and external heaters are operated for a temperature rising period and only the external heater is operated after a temperature of the toner reached the first preset temperature.

In an externally and internally heating type toner image fixing device according to the present invention, it is possible to rapidly raise a surface temperature of a fixing roller to a second preset (target) value by changing electric power (wattage) to the internal heater since only the internal heater is operated for a temperature rising period and only the external heater is operated after the a temperature of the toner reached the first preset temperature.

In an externally and internally heating type toner image fixing device according to the present invention, it is possible to rapidly rise a surface temperature of a fixing roller to a second preset (target) value since the paired. rollers are rotated while only the internal heater in the roller is heated with electric power until the cylindrical surface of the roller gets the first preset temperature, the paired rollers are forcibly spaced from each other while the external heater is heated with electric power to increase the temperature of the cylindrical surface of the roller containing the internal heater from the first preset temperature to a second preset temperature, and the paired rollers are released to press against each other when the toner image is fixed onto the recording medium.

In an externally and internally heating type toner image fixing device according to the present invention, it is possible to rapidly raise a surface temperature of a fixing roller to a second preset (target) value since the paired rollers are rotated while the external heater is supplied with electric power.

We claim:

1. A toner image fixing device, for use in an image forming device, which comprises a heating roller with a heater disposed therein for heating the roller surface to a desired temperature, a pressure roller for pressing a toner-image carrying medium against the heating roller and which is capable of maintaining the heating roller surface at a temperature suitable for fixing an unfixed toner-developed image onto the medium by supplying electric power to the heater, and which is provided with a temperature control system that controls a first preset temperature, at which a covering layer of the heating roller cannot peel off, and controls a second preset temperature, being higher than the first preset temperature and suitable for fixing a toner-developed image onto the toner-image carrying medium, and that includes a temperature sensor for detecting a surface temperature of a heating roller, a comparator for comparing a temperature, detected by the temperature sensor, with the first preset temperature and the second preset temperature and control means which operates the heater at a first preset ON-OFF ratio to heat the heating roller surface to the second preset temperature when the temperature detected by the temperature sensor and compared by the comparator is equal to or higher than the first preset temperature and thereafter serves to maintain the heating roller surface at the second preset temperature and that also operates the heater at a second preset ON-OFF ratio, said second ratio having a longer ON-duration in comparison with the first ON-OFF ratio, in response to the operation of the image forming device, to maintain the heating roller surface temperature at the second preset temperature.

2. A toner image fixing device for use in an image forming device, which comprises a heating roller with a heater disposed therein for heating the roller surface to a desired temperature, a pressure roller for pressing a toner-image carrying medium against the heating roller and which is capable of maintaining the heating roller surface at a temperature suitable for fixing an unfixed toner-developed image onto the medium by supplying electric power to the heater, and which is provided with a temperature control system that controls a first preset temperature at which a covering layer of the heating roller cannot peel off and controls a second preset temperature, being higher than the first preset temperature and suitable for fixing a toner-developed image onto the toner-image carrying medium, and that includes a temperature sensor for detecting a surface temperature of the heating roller, a comparator for comparing a temperature detected by the temperature sensor with the first preset temperature and the second preset temperature and a control means that continuously operates the heater immediately after turning on the electric power supply, drives the heating roller and the pressure roller into rotation, operates the heater at a first preset ON-OFF ratio to heat the heating roller surface to the second preset temperature while the temperature detected by the temperature sensor and compared by the comparator is equal to or higher than the first preset temperature and stops the rotation of the heating roller and the pressure roller when the heating roller reaches the second preset temperature and that also operates the heater at a second preset ON-OFF ratio, said second ratio having a longer ON-duration in comparison with the first ON-OFF ratio, in response to the operation of the image forming device to maintain the heating roller surface temperature at the second preset temperature.

3. A toner image fixing device for use in an image forming device according to claim 1 or 2, wherein the first ON-OFF ratio for operating the heater is set so as not to allow the heating roller to exceed an upper limit temperature at which the heating roller layer may not peeling-off the core, and a ratio of ON-duration to OFF-duration is set to not more than 1.

4. A toner image fixing device for use in an image forming device according to claim 1 or 2, wherein a second ON-OFF ratio for operating the heater to maintain the heating roller surface temperature at the second preset temperature in response to the operation of the image forming device has a larger proportion of ON-duration in comparison with the first ON-OFF ratio.

5. A toner image fixing device which comprises a pair of rollers through which a recording medium, carrying an unfixed toner image formed thereon, passes under a contact pressure, an internal heater disposed in at least one of said rollers and an external heater disposed opposite to a surface of the recording medium whereon the toner image formed, and which is capable of fixing the toner image onto the recording medium by heat by using the internal heater and the external heater, wherein both heaters are operated, during a period of rising temperature, to heat the toner to a first preset temperature lower than the melting point of the unfixed toner, and only the external heater is operated after the toner has reached the first preset temperature, to heat and maintain toner at a second preset temperature for fixing the toner image onto the recording medium.

6. A toner image fixing device as defined in claim 5, wherein the paired roller are rotated while only the internal heater in the roller is heated with electric power until the cylindrical surface of the roller gets the first preset temperature, the paired rollers are forcibly spaced from each other while the external heater is heated with electric power to rise the temperature of the cylindrical surface of the roller containing the internal heater from the first preset temperature to a second preset temperature, and the paired rollers are released to press against each other when the toner image is fixed onto the recording medium.

7. A toner image fixing device, comprising a pair of rollers through which a recording medium, carrying an unfixed toner image formed thereon, passes under a contact pressure, an internal heater disposed in at least one of said rollers and an external heater disposed opposite to a surface of the recording medium whereon the toner image formed, and which is capable of fixing the toner image onto the recording medium by heat by using the internal heater and the external heater, wherein both heaters are operated to heat the toner to a first present temperature lower than the melting point of the unfixed toner and only the external heater is operated thereafter to heat and maintain toner at a second present temperature for fixing the toner image onto the recording medium, wherein only the internal heater is operated for a period of rising temperature and only the external heater is operated after temperature of the toner has reached the first preset temperature.

8. A toner image fixing device as defined in claim 7, wherein the paired rollers are rotated while only the internal heater in the roller is heated with electric power until the cylindrical surface of the roller reaches the first preset temperature, the paired rollers are forcibly spaced from each other while the external heater is heated with electric power to raise the temperature of the roller containing the internal heater from the first preset temperature to the second preset temperature, and the paired rollers are released to press against each other when the toner image is fixed onto the recording medium.

9. A toner image fixing device as defined in claim 5 or claim 7 or claim 6 or claim 8, wherein the paired rollers are rotated while the electric heater is supplied with electric power.

* * * * *